US007424235B2

(12) United States Patent
Mori et al.

(10) Patent No.: US 7,424,235 B2
(45) Date of Patent: Sep. 9, 2008

(54) IMAGE FORMING APPARATUS

(75) Inventors: Akihito Mori, Toride (JP); Nobuo Sekiguchi, Moriya (JP); Tadaaki Saida, Kashiwa (JP); Keita Takahashi, Abiko (JP)

(73) Assignee: Canon Kabushiki Kaisha (JP)

( * ) Notice: Subject to any disclaimer, the term of this patent is extended or adjusted under 35 U.S.C. 154(b) by 240 days.

(21) Appl. No.: 11/530,926

(22) Filed: Sep. 12, 2006

(65) Prior Publication Data

US 2007/0059013 A1 Mar. 15, 2007

(30) Foreign Application Priority Data

Sep. 12, 2005 (JP) ..... 2005-264427
Sep. 13, 2005 (JP) ..... 2005-266038
Sep. 5, 2006 (JP) ..... 2006-240794

(51) Int. Cl.
*G03G 15/20* (2006.01)

(52) U.S. Cl. ..... 399/69; 399/329; 219/216

(58) Field of Classification Search ..... 219/216; 399/67, 69, 70, 320, 329
See application file for complete search history.

(56) References Cited

U.S. PATENT DOCUMENTS 6,055,390 A * 4/2000 Kurotaka et al. ..... 399/69
2003/0231893 A1* 12/2003 Yoshikawa ..... 399/69
2005/0220467 A1* 10/2005 Takahashi et al. ..... 399/45

FOREIGN PATENT DOCUMENTS

JP 61-132972 A 6/1986
JP 11-194647 A 7/1999
JP 2004-163868 A 6/2004

* cited by examiner

*Primary Examiner*—Hoang Ngo
(74) *Attorney, Agent, or Firm*—Rossi, Kimms & McDowell, LLP

(57) ABSTRACT

In an image forming apparatus including a fixing device that uses a pressure belt as at least one of two pressing members, a warm-up time and time for shifting to a standby state are reduced with simple control without increasing power consumption. The two pressing members are brought into a press-contact state by a contacting/separating mechanism and only heating means on the upper side is turned on. When the temperature of the upper pressing member increases to temperature near a target temperature corresponding thereto, the pressing members are driven to rotate. When it is detected by temperature detecting means on the lower side that the temperature of the lower pressing member increases to temperature near a target temperature corresponding thereto, the two pressing members are brought into a separated state by the contacting/separating mechanism.

12 Claims, 13 Drawing Sheets

IMAGE FORMING APPARATUS

BACKGROUND OF THE INVENTION

1. Field of the Invention

The present invention relates to an image forming apparatus that applies heat and pressure to a recording medium having an image formed thereon to fix the image.

2. Description of the Related Art

Conventionally, in an image forming apparatus that forms an image on a recording medium in accordance with the electrophotographic system, a fixing device is used in order to fix a toner image formed by a toner consisting of thermo-melting type resin or the like on the recording medium. In a sublimation type or thermal transfer type printer and the like, a fixing device is also used for fixing of an image formed on a recording medium and modification of surface properties of the recording medium.

Most of fixing devices adopted in electrophotographic apparatuses and the like are heat-pressing type fixing devices that heat and press recording mediums to melt and fix toner images placed thereon.

The heat-pressing fixing devices are roughly categorized into two types. One is a fixing device of a roller type fixing system in which a pair of rollers are opposed to be in press-contact with each other, a heating source is arranged in one or both of the rollers, and a recording medium is conveyed while being nipped in a press-contact section of the rollers to perform fixing process. The other is a fixing device of a so-called belt type fixing system in which one of pressing members is constituted by a roller and the other is constituted by a belt.

The roller type fixing system has, as a basic structure, a roller pair of a fixing heat roller and a pressure roller in which temperature of the fixing heat roller is adjusted to a predetermined fixing temperature, and the pressure roller comes into press-contact with the fixing roller. This roller pair is rotated to lead a recording medium having an unfixed toner image formed thereon into a fixing nip section, which is a press-contact section of the roller pair, to nip and convey the recording medium. The unfixed toner image is heat-pressed and fixed on the recording medium by the heat of the fixing roller and the pressure at the fixing nip section.

A heat quantity given to the recording medium having the unfixed toner image deposited thereon depends on the temperature of the fixing roller and the pressure roller and time during which the recording medium passes the fixing nip section, that is, a fixing nip width and conveying speed of the recording medium. The fixing nip width indicates length of the recording medium in a conveying direction at the fixing nip section.

As a fixing device mounted on an electrophotographic apparatus or the like having a higher process speed, a fixing device with a larger fixing nip width is required because of the relation with the heat quantity. An increase in diameters of the rollers is required in order to increase the fixing nip width in the roller type fixing system. However, when the diameters of the rollers are increased, there are problems in that, for example, a heat capacity of the rollers increases and accordingly, heat-up time (warm-up time) of the rollers increases.

As a fixing device structure with which a large fixing nip width can be secured without increasing diameters of rollers as disclosed in, for example, Japanese Patent Laid-Open No. 61-132972, wherein a fixing device of a belt type fixing system is proposed.

In such a fixing device of the belt type fixing system, a heat-resistant and flexible endless belt stretched among plural belt stretching members is brought into press-contact with a fixing roller serving as a rotating member for heating to form a fixing nip portion. A recording medium having an unfixed toner image born thereon is nipped and conveyed by this fixing nip section. Consequently, the unfixed toner image is heat-pressed and fixed on the recording medium by the heat of the fixing roller and the pressure of the fixing nip section. In this fixing device of the belt system, it is possible to easily set a fixing nip width larger according to adjustment of a contact width of the endless belt against the fixing roller. Since it is possible to secure the fixing nip width without depending on the diameter of the fixing roller, it is possible to form the fixing roller to have a small diameter with a small heat capacity and to reduce a warm-up time.

In order to stabilize the quality of an image finally obtained in an electrophotographic apparatus or the like, control of heat applied to an image forming surface is important. Therefore, various systems are proposed for temperature control or temperature adjustment for a fixing device. For example, in Japanese Patent Laid-Open No. 2004-163868, a fixing device having a structure including heaters in upper and lower pressing members is disclosed. In this Japanese Patent Application Laid-Open No. 2004-163868, it is mentioned that maximum electric power is supplied to an upper heater included in the upper pressing member and, when the temperature of the fixing device reaches a predetermined temperature, electric power supplied to the upper heater is reduced and electric power is also supplied to a lower heater included in the lower pressing member to perform the temperature control.

More specifically, at the time of a warm-up operation, in a state in which a fixing belt and an opposed roller are brought into contact with each other, maximum electric power is supplied to first heating means provided on the inside of a heating roller of the fixing belt to heat the fixing belt only with the first heating means. Subsequently, when the temperature of the fixing belt reaches a first reference temperature, the fixing belt is rotated, and simultaneously the supplied electric power to the first heating means is reduced. Moreover, electric power is also supplied to second heating means provided on the inside of the opposed roller to make it possible to perform a fixing operation when the temperature of the fixing belt reaches a target temperature and the temperature of the opposed roller reaches a second reference temperature.

SUMMARY OF THE INVENTION

However, in a temperature control method described in Japanese Patent Application Laid-Open No. 2004-163868, problems described below tend to occur.

(1) When electric power supplied to the upper heater is reduced and electric power equivalent to the reduction of electric power is supplied to the lower heater, control of electric power distribution is complicated under various conditions.

(2) When electric power is supplied to the upper heater in a state in which upper and lower pressing members are in contact with each other, the upper pressing member is deprived of the temperature thereof by the lower pressing member. As a result, a warm-up time until the temperature of the upper pressing member becomes longer.

On the other hand, when electric power is supplied to the upper heater in a state in which the upper and lower pressing members are separated from each other, it is impossible to increase the temperature of the lower pressing member. Therefore, the temperature of the upper pressing member suddenly falls at an instance when both the pressing members come into contact with each other. Consequently, the warm-up time becomes longer unless the temperature of the upper pressing member is set higher than a predetermined temperature.

In the fixing device including the fixing roller on the upper side and the pressure belt on the lower side as the pressing members as described in Japanese Patent Application Laid-Open No. 61-132972, problems described below also tend to occur. It is known that, when the fixing roller and the pressure belt are always set in a press-contact state, a durability of the fixing device is reduced because of deformation or the like of the fixing roller. Further, if a temperature difference equal to or larger than a predetermined temperature difference is not provided between the fixing roller and the pressure belt, an abnormal image called blister is generated. Moreover, when the fixing roller and the pressure belt have the same temperature, a recording medium is conveyed in a state in which the recording medium adheres to the belt. It is known that it is difficult to separate the recording medium from the pressure belt. A separation failure of the recording medium from the pressure belt tends to occur.

In an attempt to cope with such problems of a durability, an abnormal image, and separability of a recording medium, a structure for separating a fixing roller and a pressure belt from each other except at the time of execution of a fixing operation, that is, at the time of conveyance of the recording medium is proposed in Japanese Patent Application Laid-Open No. 11-194647.

In general, in a fixing device including a fixing roller on an upper side (an image forming surface side) and a pressure belt on a lower side (an image rear surface side), in order to reduce power consumption of an entire image forming apparatus, a heater having a heating values larger than that of a heater for the pressure belt is used as a heater for the fixing roller. The heater for the fixing roller is preferentially turned on even during an image forming operation other than a fixing operation and during standby state.

Temperature control for the pressure belt is discussed below. Usually, the heater for the pressure belt heats a part of the pressure belt. However, since the pressure belt moves to a fixing nip position in a state in which the pressure belt is driven to rotate, a surface temperature of the pressure belt falls. In other words, heat is radiated from the heated portion while the pressure belt makes one revolution. Therefore, time required to increase the temperature of the entire pressure belt is longer than time required to increase the temperature of the fixing roller.

Similarly, once the temperature of the pressure belt falls, the pressure belt requires long time for temperature reset compared with the fixing roller.

The invention has been devised in view of the situation described above, and it is an object of the invention to reduce a warm-up time and time for shifting to a standby state with simple control without increasing power consumption in an image forming apparatus including a fixing device that uses a pressure belt as at least one of two pressing members.

An image forming apparatus according to an aspect of the invention for attaining the object is an image forming apparatus including: an image forming unit that forms an image on a recording medium; a heating member and a pressing member that form a nip section to heat and press the image formed on the recording medium; a separating mechanism that separates the heating member and the pressing member; and a first temperature detecting unit that detects temperature of the pressing member, wherein, in forming the nip section with the heating member and the pressing member to heat the heating member to a target temperature, if a detected temperature of the pressing member reaches a first temperature lower than the target temperature, the heating member and the pressing member are separated from each other.

An image forming apparatus according to another aspect of the invention for attaining the object is an image forming apparatus including: an image forming unit that forms an image on a recording medium; a heating member that heats the image formed on the recording medium in a nip section; an endless belt that conveys the recording medium toward the nip section formed between the endless belt and the heating member; a separating mechanism that separates the heating member and the endless belt; and a first temperature detecting unit that detects temperature of the endless belt, wherein in forming the nip section with the heating member and the endless belt to heat the heating member to a target temperature, if a detected temperature of the endless belt reaches a first temperature lower than the target temperature, the heating member and the endless belt are separated from each other.

In this way, in increasing the temperatures of both the pressing members to respective target temperatures, the pressing members are brought into a press-contact state and driven to rotate. This makes it possible to control the temperatures of the two pressing members to increase to the respective target temperatures.

Consequently, in increasing the temperatures of the two pressing members to the respective target temperatures, complicated control for properly controlling the respective heating means is unnecessary and it is possible to efficiently increase the temperatures of the two pressing members. Therefore, it is possible to reduce a warm-up time and time for shifting to a standby state with simple control without increasing power consumption.

Further, it is possible to eliminate temperature unevenness in a conveying direction of the recording medium in the fixing nip and prevent an image failure from occurring in an image printed on the recording medium.

Further features of the present invention will become apparent from the following description of exemplary embodiments with reference to the attached drawings.

DESCRIPTION OF THE EMBODIMENTS

Preferred embodiments of the invention will be hereinafter illustratively explained in detail with reference to the accompanying drawings. Elements described in the embodiments are only examples and it is not meant to limit the scope of the invention only to the elements.

<Structure of an Image Forming Apparatus>

Figure 11:
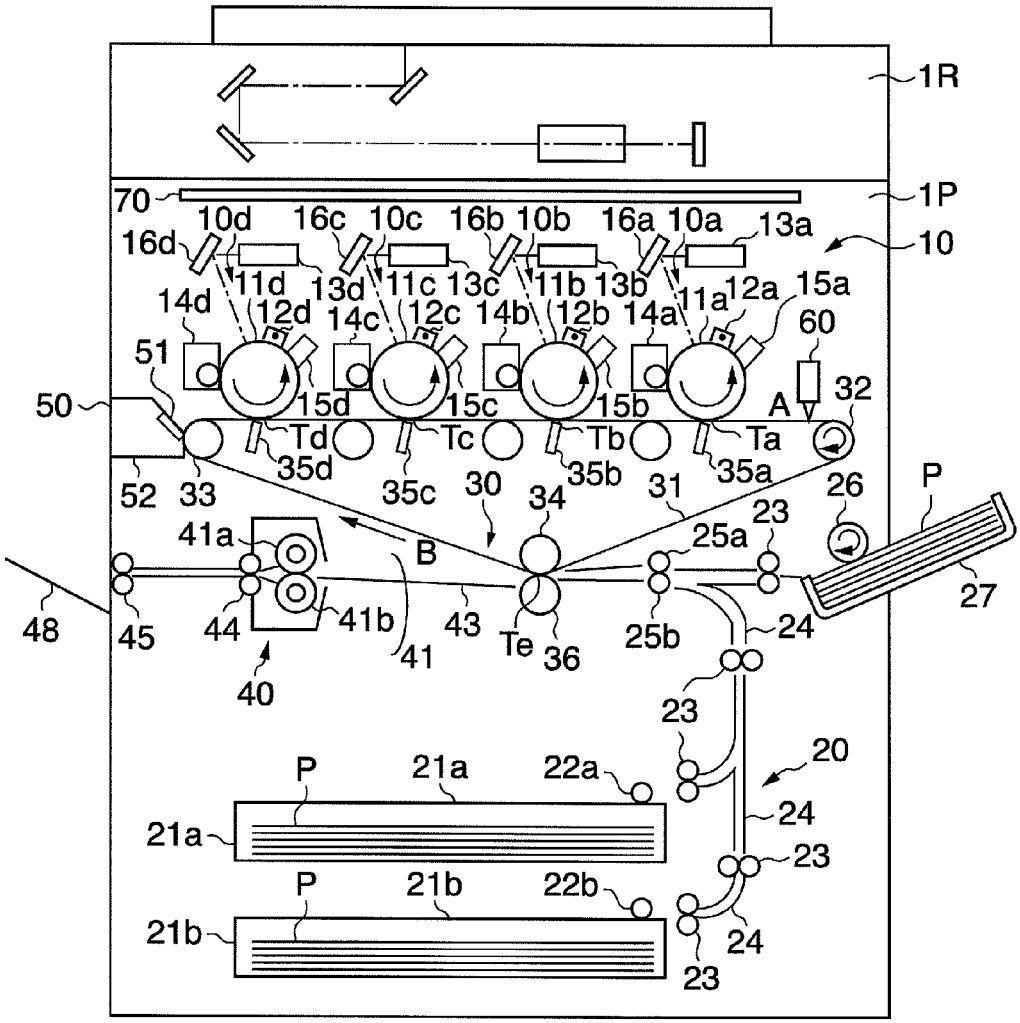
FIG. 11 is a main part sectional view of an image forming apparatus to which the fixing device of the image forming apparatus according to the invention is applicable.

FIG. 11 is a main part sectional view of an image forming apparatus to which a fixing device of an image forming apparatus according to the invention is applicable. This image forming apparatus forms a color image on a recording medium in accordance with the electrophotographic system.

A schematic operation of the image forming apparatus is explained. First, the image forming apparatus reads an image of an original in an optical system 1R and forms an image on a recording medium (a transfer material) P according to image information from the optical system 1R in an image output section 1P. Moreover, plural image forming units are arranged in parallel in association with four developers (hereinafter referred to as "toners") of four colors of yellow, cyan, magenta, and black used in the image output section 1P and the intermediate transfer system is adopted to form a color image.

The image output section 1P roughly includes an image forming section 10, a sheet feeding unit 20, an intermediate transfer unit 30, a fixing unit 40, and a control section (not shown). In the image forming section 10, four stations 10*a*, 10*b*, 10*c*, and 10*d* corresponding to the colors of the toners used are arranged in parallel and each of them has an identical structure.

The respective units are explained in detail. The image forming section 10 has a structure described below. Photosensitive drums 11*a*, 11*b*, 11*c*, and 11*d* serving as image bearing members are pivotally supported in the centers thereof and driven to rotate in an arrow direction. Primary chargers 12*a* to 12*d*, exposing sections 13*a* to 13*d* of an optical system, mirrors 16*a* to 16*d*, and developing devices 14*a* to 14*d* are arranged in the rotating direction of the photosensitive drums 11*a* to 11*d* to be opposed to outer peripheral surfaces of the photosensitive drums 11*a* to 11*d*.

In the primary chargers 12*a* to 12*d*, charges of a uniform charge amount are given to the surfaces of the photosensitive drums 11*a* to 11*d*. Beams such as laser beams modulated according to a recording image signal by the exposing sections 13*a* to 13*d* are irradiated on the photosensitive drums 11*a* to 11*d* via the mirrors 16*a* to 16*d* to expose the photosensitive drums 11*a* to 11*d* to the beams by the exposing sections 13*a* to 13*d* to thereby form electrostatic latent images thereon.

The electrostatic latent images are visualized by the developing devices 14*a* to 14*d* having the toners of the four colors of yellow, cyan, magenta, and black stored therein, respectively. Visible images visualized are transferred to image transfer areas Ta, Tb, Tc, and Td of the intermediate transfer belt 31 serving as an intermediate transfer member.

When the photosensitive drums 11*a* to 11*d* rotate, in downstream of the image transfer areas Ta to Td, the toners not transferred onto the intermediate transfer belt 31 and remaining on the photosensitive drums 11*a* to 11*d* are scraped off by cleaning devices 15*a* to 15*d* to clean the surface of the drums. According to the process described above, image formation by the respective toners is sequentially performed.

The sheet feeding unit 20 includes cassettes 21*a* and 21*b* and a manual feed tray 27 for storing recording media P serving as transfer materials. The recording media P are delivered one by one from the cassettes 21*a* and 21*b* or the manual feed tray 27 by pickup rollers 22*a*, 22*b*, and 26. The recording medium P delivered from each of the pickup rollers 22*a*, 22*b*, and 26 is conveyed to registration rollers 25*a* and 25*b* by a sheet feeding roller pair 23 and a sheet feeding guide 24. The recording medium P is delivered to a secondary transfer area Te by registration rollers 25*a* and 25*b* according to image formation timing of the image forming section.

The intermediate transfer unit 30 is now explained in detail. The intermediate transfer belt 31 is wound and suspended around a driving roller 32 that transmits a driving force to the intermediate transfer belt 31, a driven roller 33 that follows the rotation of the intermediate transfer belt 31, and a secondary transfer opposed roller 34 that is opposed to the secondary transfer area Te across the intermediate transfer belt 31 serving as winding and suspending rollers. A primary transfer plane A is formed between the driving roller 32 and the driven roller 33 among the rollers. The driving roller 32 is coated with rubber (urethane or chloroprene) with thickness of several millimeters on the surface of a metal roller to prevent slip on the intermediate transfer belt 31. The driving roller 32 is driven to rotate in an arrow direction by a pulse motor (not shown). The intermediate transfer belt 31 is rotated in a direction of arrow B.

The primary transfer plane A is opposed to the respective image forming sections 10*a* to 10*d*. The respective photosensitive drums 11*a* to 11*d* are opposed to the primary transfer surface A of the intermediate transfer belt 31. Thus, the primary transfer areas Ta to Td are located on the primary transfer surface A.

In the primary transfer areas Ta to Td to which the respective photosensitive drums 11*a* to 11*d* and the intermediate transfer belt 31 are opposed, primary transfer chargers 35*a* to 35*d* are arranged on the back of the intermediate transfer belt 31. A secondary transfer roller 36 is arranged to be opposed to the secondary transfer opposed roller 34 and forms the secondary transfer area Te according to a nip section formed with the intermediate transfer belt 31. The secondary transfer roller 36 is pressed against the intermediate transfer belt 31 at proper pressure. A cleaning blade 51 for cleaning the image forming surface of the intermediate transfer belt 31 and a waste toner box 52 for storing waste toners are provided downstream the secondary transfer area Te on the intermediate transfer belt 31.

The fixing unit 40 includes a roller pair 41 of a fixing roller 41*a* and a pressure roller 41*b*, a guide 43, an inner sheet discharge roller 44, and an outer sheet discharge roller 45. The fixing roller 41*a* includes a heat source such as a halogen heater in the inside thereof. A heat source may be further provided in the pressure roller 41*b*. The guide 43 guides the recording medium P to a nip section of the roller pair 41. The inner sheet discharge roller 44 and the outer sheet discharge roller 45 further guide the recording medium P discharged from the roller pair 41 to the outside of the apparatus.

In FIG. 11, the image forming apparatus is explained using the roller pair 41 including the pressure roller 41*b*. However, in an embodiment of this application, an image forming apparatus will be explained in detail using a pressure belt unit 41*b*' together—with a fixing roller unit 41*a*' shown in FIG. 1 instead of the fixing roller 41*a* and the pressure roller 41*b*.

Operations of the image forming apparatus shown in FIG. 11 will be explained.

When a start signal for an image forming operation is issued by a not-shown control unit, the recording media P are delivered one by one from the cassettes 21*a* and 21*b* or the manual feedtray 27 by the pickup rollers 22*a* and 22*b* or 26 according to a sheet size or the like of a recording medium P selected. The recording medium P is guided through the sheet feeding guide 24 and conveyed to the registration rollers 25*a* and 25*b* by the sheet feeding roller pair 23. At that time, the registration rollers 25*a* and 25*b* are stopped and the leading end of the recording medium P comes into contact with the nip section. Thereafter, the registration rollers 25*a* and 25*b* start rotating according to timing at which the image forming sections 10*a* to 10*d* start formation of images. Timing of the rotation of the registration rollers 25*a* and 25*b* is set such that the recording medium P and a toner image primarily transferred onto the intermediate transfer belt 31 by the image forming section 10 precisely coincide with each other in the secondary transfer area Te.

On the other hand, in the image forming unit 10, when a start signal for an image forming operation is issued from the control unit, a toner image (a developed image) is formed on the photosensitive drum 11*d* located most upstream in a rotating direction B of the intermediate transfer belt 31 according to the process described above. This toner image is primarily transferred onto the intermediate transfer belt 31 in the primary transfer area Td by the primary transfer charger 35*d* to which a high voltage is applied.

The toner image primarily transferred is carried to the next primary transfer area Tc. In the primary transfer area Tc, image formation is performed with a delay by time in which the toner image is carried among the respective image forming sections 10. The next toner image is transferred onto the preceding image with positions of the images put together. The same process is repeated for the primary transfer areas Ta and Tb of the other colors. Finally, the toner images of the four colors are primarily transferred onto the intermediate transfer belt 31.

Thereafter, when the recording medium P enters the secondary transfer area Te and comes into contact with the intermediate transfer belt 31, a high voltage is applied to the secondary transfer roller 36 according to timing of conveyance of the recording medium P. The toner images of the four colors formed on the intermediate transfer belt 31 according to the process described above are collectively transferred onto the surface of the recording medium P. Thereafter, the recording medium P is accurately guided to the nip section of the fixing roller pair 41 by the conveyance guide 43. The toner images are fixed on the paper surface by heat of the fixing roller pair 41 and pressure at the nip section. Thereafter, the recording medium P is conveyed and discharged to the outside of the apparatus by the inner and outer sheet discharge rollers 44 and 45.

In the image forming apparatus of this type, deviation of registration of the respective color images formed on the respective photosensitive drums 11*a* to 11*d*, that is, color drift or misregistration may occur. Reason for the occurrence of the color drift are a mechanical attachment error among the respective photosensitive drums 11*a* to 11*d*, an optical path length error and an optical path change of a laser bam caused by the respective exposing sections 13*a* to 13*d*, warp of an LED due to an environmental temperature, and the like. In order to correct such deviation of the images, a registration sensor 60 that detects deviation of images is provided in a downstream position of all the image forming sections 10 and in a position before the belt 31 is returned by the driving roller 32 on the primary transfer plane A.

<Structure of a Fixing Device>

Figure 1:
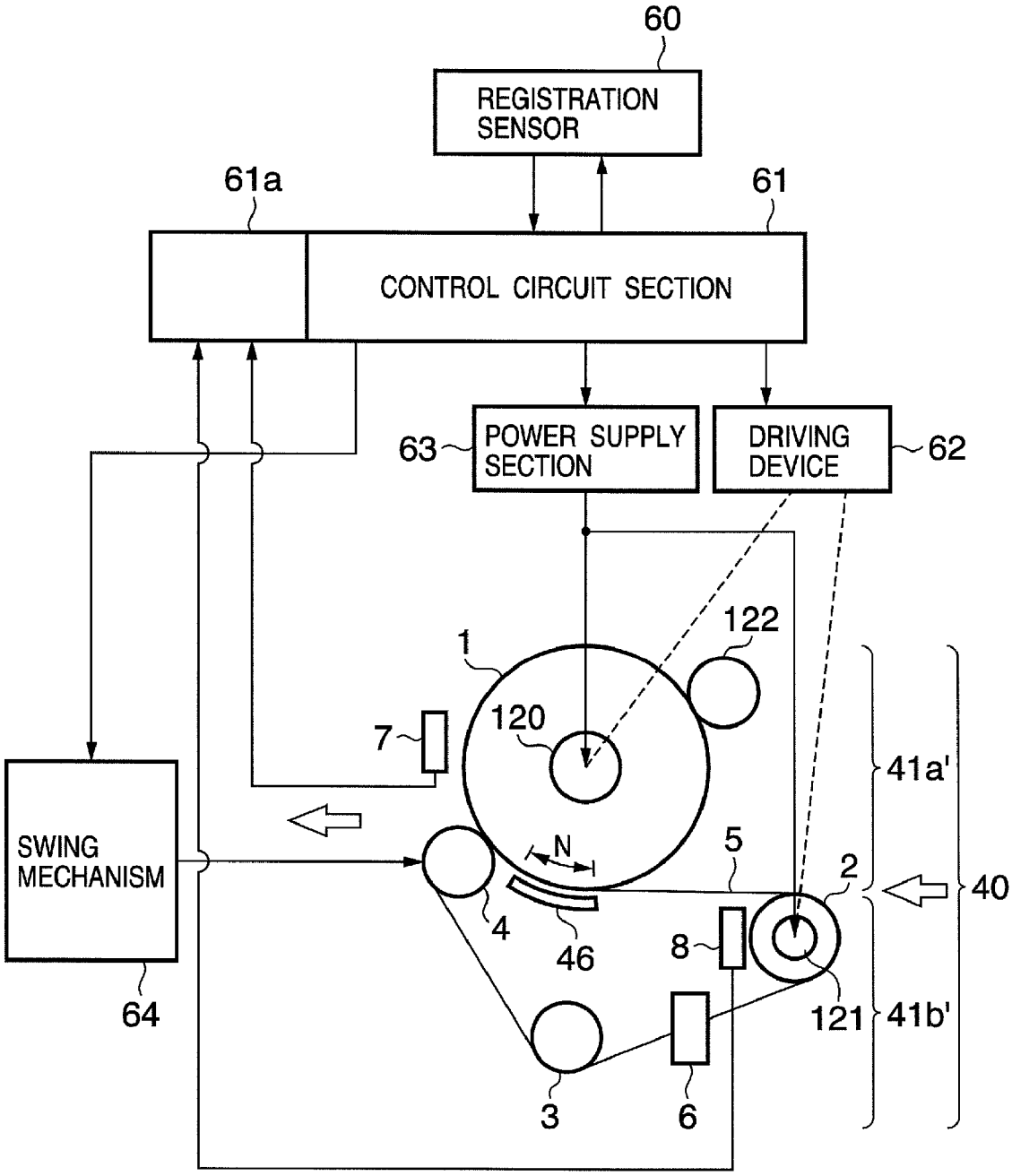
FIG. 1 is a main part sectional view showing a structure of an embodiment of a fixing device applied to an image forming apparatus according to the invention.

A fixing device of the image forming apparatus according to the invention usable as the fixing unit 40 of the image forming apparatus described above will be hereinafter explained. FIG. 1 is a main part sectional view showing a structure of an embodiment of the fixing device 40 of the image forming apparatus according to the invention and a block diagram of a control system. The image forming apparatus is explained using the roller pair 41 including the fixing roller 41*a* and pressure roller 41*b* in FIG. 11. However, the fixing device 40 according to an embodiment of this application is explained in detail using the fixing roller unit 41*a*' and the pressure belt unit 41*b*'.

In FIG. 1, reference numeral 1 denotes a fixing roller in the fixing roller unit 41*a*' serving as an upper pressing member (a fixing rotating member). An upper roller heater (a halogen lamp) 120 serving as a heating source is provided in the inside of the fixing roller 1. In this fixing roller 1, an elastic layer of silicon rubber or the like is coated over a hollow core metal and a fluorine coat layer is coated on a surface layer of the elastic layer as a release layer. An external heating roller 122 having a heater serving as a heating source in the inside thereof is arranged to be in contact with the surface of the fixing roller 1. A thermistor 7 (a first thermistor) serving as means for detecting a surface temperature of the fixing roller 1 is provided on the outside of the fixing roller 1. In a fixing operation, energization of the upper roller heater 120 is controlled while temperature of the fixing roller 1 is monitored by the thermistor 7 such that the temperature is stabilized at a target temperature. The fixing roller 1 is driven to rotate for the fixing operation and rotates to convey the recording medium P in a direction of an arrow in the figure.

In the figure, a belt denoted by reference numeral 5 and shown as being in contact with the fixing roller 1 is an endless pressure belt (a lower belt) in the pressure belt unit 41*b*' serving as a lower pressing member. The pressure belt 5 is wound and stretched to surround the driving roller 2, a steering roller 3, and a separation roller 4 serving as belt stretching members to constitute the pressure belt unit 41*b*'. The pressure belt 5 is a belt obtained by forming a heat-resistant resin material such as polyimide in an endless belt shape. This pressure belt 5 is driven to rotate by the driving roller 2 to convey the recording medium P in a direction of an arrow in the figure in the fixing operation. The steering roller 3 and the separation roller 4 rotate following the rotational drive of the pressure belt 5 according to the rotation of the driving roller 2 and support the rotation of the pressure belt 5 in a state in which tension is maintained.

A belt heater 121 is provided in the inside of the driving roller 2. A second thermistor 8 is provided on the outside of the driving roller 2 as detecting means for detecting a surface temperature of the pressure belt 5. In a fixing operation, the belt heater 121 is intermittently turned on while temperature is monitored by the thermistor 8 such that the temperature is stabilized at a target temperature. In the fixing operation, as described above, since the heated driving roller 2 is driven to rotate, it is possible to transmit temperature to the entire pressure belt 5. A pressing member 46 that comes into press-contact with the fixing roller 1 to form a fixing nip section is further provided.

In this way, in the fixing device 40 in the image forming apparatus according to this embodiment, in the fixing operation, the fixing roller 1 and the pressure belt 5 are driven to rotate while temperatures of the fixing roller 1, the external heating roller 122, and the pressure belt 5 are controlled. Heat and pressure are applied to the recording medium P to fix an image while the recording medium P passes between the fixing roller 1 and the pressure belt 5 at the nip section. Reference numeral 6 denotes sensors for detecting an offset state in a depth direction of the pressure belt 5. The sensors 6 are arranged on an inner side and a front side in the figure.

Figure 2:
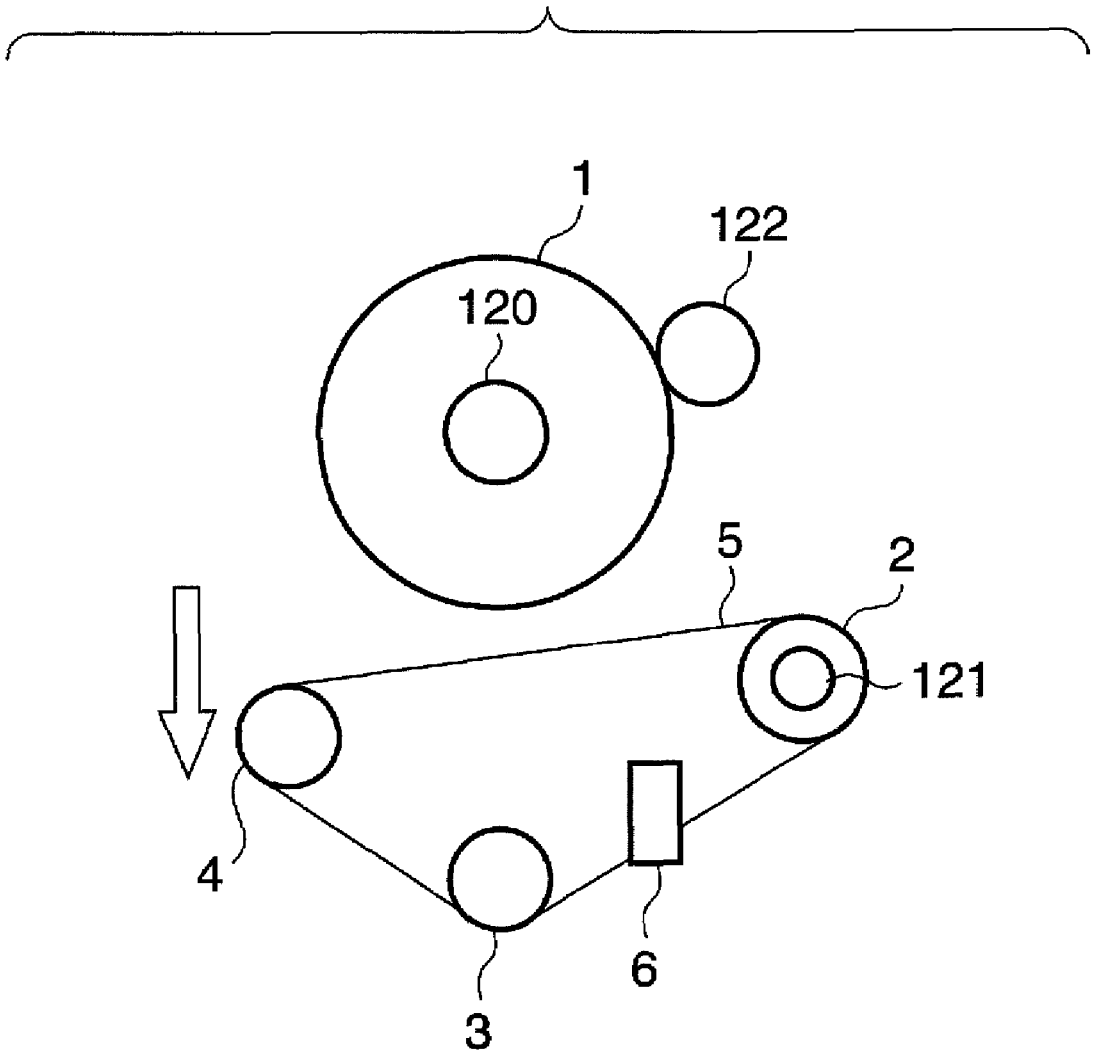
FIG. 2 is a diagram showing a state in which a pressure belt is separated from a fixing roller in the fixing device of FIG. 1.

In the fixing device 40 in the image forming apparatus according to this embodiment, it is possible to separate the pressure belt 5 from the fixing roller 1. FIG. 2 shows a state in which the pressure belt 5 and the fixing roller 1 are separated from each other. In this state, the pressure belt 5 is moved to rotate, together with the separation roller 4, a predetermined angle in a downward direction in the figure around the driving roller 2 by a swing mechanism 64 serving as separating means, that is, contacting/separating means for bringing the fixing roller 1 and the pressure belt 5 into contact with each other and separating the fixing roller 1 and the pressure belt 5. The swing mechanism 64 can also be constituted by, for example, an electromagnetic solenoid-plunger mechanism, a cam mechanism, or a lever mechanism.

The swing mechanism 64 swings the pressure belt unit 41*b*' vertically or rotationally moves the pressure belt unit 41*b*' with respect to the fixing roller 1 around the driving roller 2 according to the control by a control circuit section 61, that is, controlling means.

1) As shown in FIG. 1, the pressure belt unit 41*b*' is rotated in a lifting direction with respect to the fixing roller 1 to bring the separation roller 4 into contact with the fixing roller 1 with the pressure belt 5 nipped between the separation roller 4 and the fixing roller 1. The pressure belt unit 41*b*' is switched to and held in a first position where an outer surface of a pressure belt portion between the separation roller 4 and the driving roller 2 is in a state of contact with the lower surface of the fixing roller 1 (an attaching operation) and 2) a second position where, as shown in FIG. 2, the pressure belt unit 41*b*' is rotated in a lowering direction from the fixing roller 1 and the separation roller 4 and the pressure belt 5 are in a separated state from the lower surface of the fixing roller 1 (a detaching operation). A removable mechanism for bringing the pressure belt 5 into contact with the fixing roller 1 and separating the pressure belt 5 from the fixing roller 1 is constituted by the pressure belt unit 41*b*' that freely swings vertically with respect to the fixing roller 1 around the driving roller 2 and the swing mechanism 64 of this pressure belt unit 41*b*'.

As shown in FIG. 1, in a state in which the pressure belt unit 41*b*' is switched to the first position, the separation roller 4 comes into press-contact with the fixing roller 1 with the pressure belt 5 nipped between the separation roller 4 and the fixing roller 1. The outer surface of the pressure belt portion between the driving roller 2 and the separation roller 4 comes into a state of contact with the lower surface of the fixing roller 1. Therefore, a wide fixing nip section N is formed between the fixing roller 1 and the pressure belt 5.

Fixing process for an unfixed toner image on the recording medium P is performed in a state in which the pressure belt unit 41*b*' is switched to the first position and the fixing nip section N is formed between the fixing roller 1 and the pressure belt 5 as described above.

In this way, in this embodiment, when the fixing operation is not performed, the pressure belt 5 is separated from the fixing roller 1 to prevent deformation of the fixing roller 1 caused by leaving the fixing roller 1 untouched for a long time. Even in a state in which the pressure belt 5 and the fixing roller 1 are separated from each other, it is possible to perform temperature control for the pressure belt 5. It is possible to rotate the pressure belt 5 by rotating the driving roller 2. It goes without saying that, in this state, it is impossible to convey the recording medium P in the arrow direction in FIG. 1.

The fixing roller 1 is driven to rotate in a clockwise direction of an arrow at predetermined speed by a driving device 62 controlled by the control circuit section 61. The pressure belt 5 rotates in a counterclockwise direction of an arrow following the rotational drive of the fixing roller 1. The pressure belt 5 is driven to rotate in the counterclockwise direction of the arrow at predetermined speed by the driving device 62 controlled by the control circuit section 61. Electric power is supplied to the halogen lamp of the upper roller heater 120 serving as a heating source of the fixing roller 1 from a power supply section 63. The fixing roller 1 is heated by heat generation of the upper roller heater 120.

A surface temperature of the fixing roller 1 is detected by the first thermistor 7. The detected temperature is inputted to a temperature control circuit section 61*a* of the control circuit section 61 as an electric signal. The temperature control circuit section 61*a* controls power supply from the power supply section 63 to the upper roller heater 120 to subject the surface of the fixing roller 1 to temperature adjustment such that an electric signal of a fixing roller temperature inputted from the first thermistor 7 is maintained as an electric signal corresponding to a predetermined fixing temperature.

The fixing roller 1 is driven to rotate, the pressure belt 5 also rotates following the rotation of the fixing roller 1, the fixing roller 1 is heated by the halogen lamp of the upper roller heater 120, and temperature of the fixing roller 1 is adjusted to the predetermined fixing temperature. In this state, the recording medium P having the unfixed toner image born thereon is led into the fixing nip section N from the driving roller 2 side of the belt unit 41*b* and nipped and conveyed through the fixing nip section N. In this nipping and conveying process, the surface of the unfixed toner image of the recording medium P closely adheres to the surface of the fixing roller 1 and the toner image is heated by heat of the fixing roller 1 and fixed on the surface of the recording medium P by heating and pressuring. The recording medium P separated from the surface of the fixing roller 1 by biting (entrance) of the fixing roller 1 into the elastic layer in a sheet exit section of the fixing nip section N and discharged and conveyed.

Electric power is supplied to the halogen lamp of the belt heater 121 serving as a heating source of the driving roller 2 of the pressure belt unit 41*b*' from the power supply section 63. The pressure belt 5 is heated by heat generation of the belt heater 121. A surface temperature of the pressure belt 5 is detected by the second thermistor 8 and the detected temperature is inputted to the temperature control circuit section 61*a* of the control circuit section 61 as an electric signal. The temperature control circuit section 61*a* controls power supply from the power supply section 63 to the belt heater 121 to subject the surface of the pressure belt 5 to temperature adjustment such that an electric signal of a pressure belt temperature inputted from the second thermistor 8 is maintained as an electric signal corresponding to the predetermined fixing temperature.

A surface temperature of the pressure belt 5 is detected by the second thermistor 8 and the detected temperature is inputted to the temperature control circuit section 61*a* of the control circuit section 61 as an electric signal.

Figure 3:
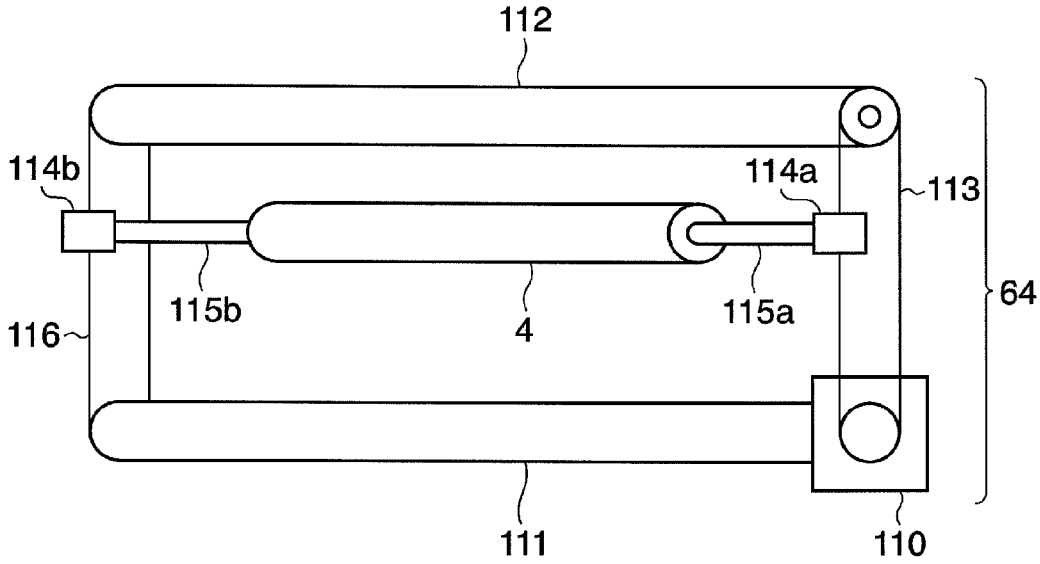
FIG. 3 is a diagram showing a driving system for rotationally moving (separating) the pressure belt around a driving roller.

FIG. 3 is a diagram showing a driving system of the swing mechanism 64 for rotationally moving the pressure belt 5 around the driving roller 2 (the contacting/separating means for bringing the fixing roller 1 and the pressure belt 5 into contact with each other and separating the fixing roller 1 and the pressure belt 5 from each other) explained with reference to FIG. 2. In the figure, the fixing device 40 in FIG. 1 is viewed from above in a discharge direction (an obliquely left side in the figure). In this figure, the pressure belt 5 is not shown.

A driving source of the separation roller 4 is a pulse motor 110. A shaft 111 of the pulse motor 110 is coupled to a driven shaft 112 opposed thereto by a moving belt 113. Therefore, when the pulse motor 110 is driven to rotate, the moving belt 113 moves and the driven shaft 112 also rotates. The pulse motor shaft 111 and the driven shaft 112 are roller shafts extending from the front surface side to the rear surface side of the fixing device 40. Therefore, on the rear surface side, by driving to rotate the pulse motor 110, the moving belt 116 moves in the same direction in association with the front surface side. A fixing section 114*a* that fixes a shaft 115*a* of the separation roller 4 is provided in a part of the moving belt 113.

The separation roller 4 has a shaft 115*b* and a fixing section 114*b* on the opposite side of the shaft 115*a* and the fixing section 114*a*. The fixing section 114*b* is fixed to the moving belt 116. Therefore, when the moving belts 113 and 116 move to rotate, the fixing sections 114*a* and 114*b* move vertically. Consequently, the separation roller 4 moves to rotate vertically together with the pressure belt 5. It is possible to control the vertical moving distance according to a pulse number transferred to the pulse motor 110. It is possible to control the vertical direction according to a rotating direction instructing signal transferred to the pulse motor 110. The pressing member 46 that fixes the nip section of the fixing roller 1 and the pressure belt 5 is also brought into contact with and separated from the nit section in synchronization with the fixing sections 114.

<Temperature Control>

Temperature control for the fixing roller 1 and the pressure belt 5 in the fixing device of the image forming apparatus according to this embodiment will be hereinafter explained. In this embodiment, different kinds of temperature control are performed at the time of warm-up performed after starting the fixing device and in the post processing performed after executing the fixing operation.

Figure 4:
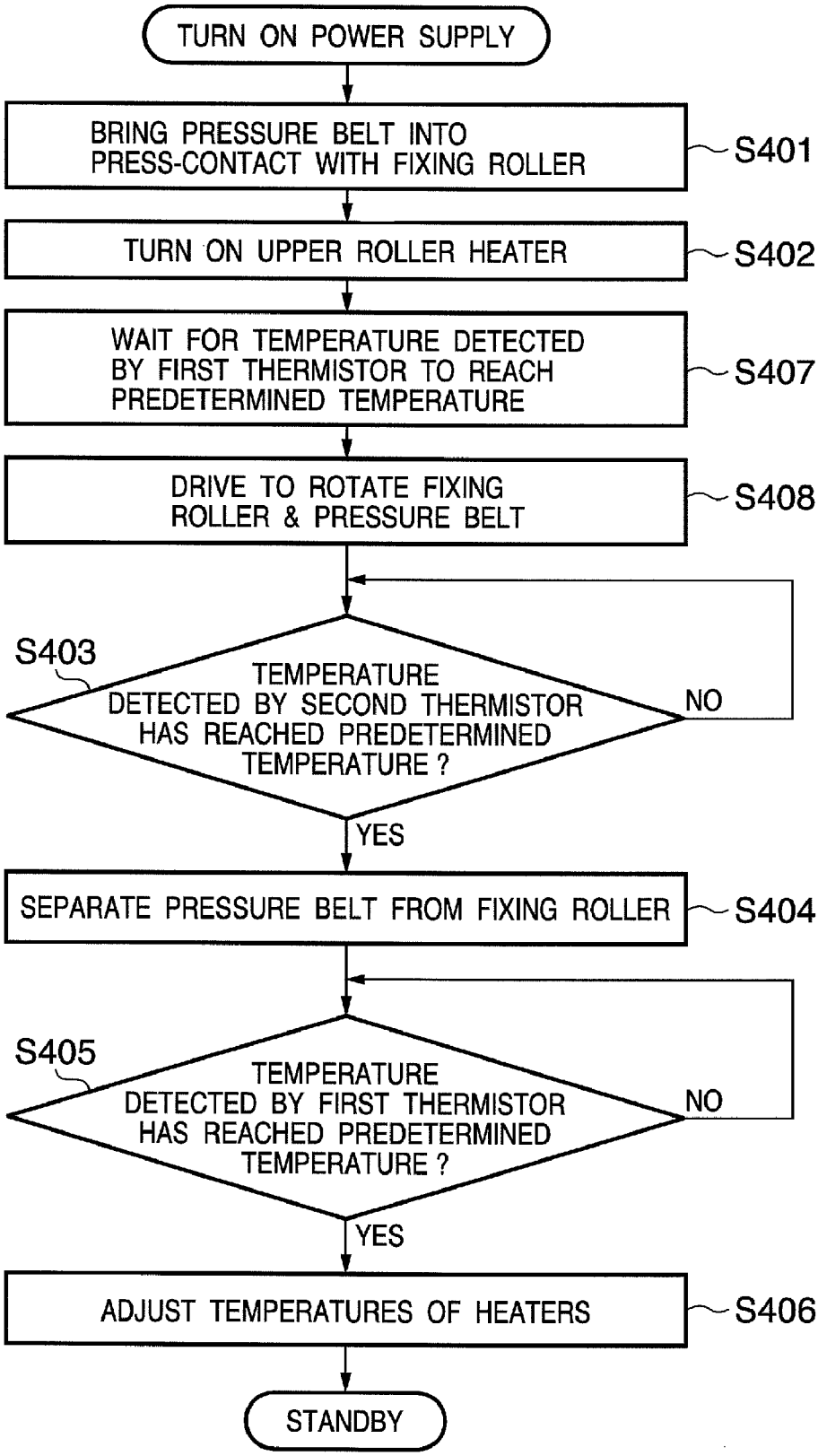
FIG. 4 is a flowchart showing processing concerning temperature control at the time of warm-up after turning on a power supply in a fixing device applied to an image forming apparatus according to a first embodiment.

FIG. 4 is a flowchart showing processing concerning temperature control at the time of warm-up after turning on a power supply in the fixing device 40 of the image forming apparatus according to this embodiment. When the power supply is turned on and the fixing device is started, control for increasing the temperatures of the fixing roller 1 and the pressure belt 5 to respective target temperatures is started. In this case, the target temperature of the fixing roller 1 is Tu, and the target temperature of the pressure belt 5 is Tl, respectively.

In this embodiment, when power is ON, electric power is supplied only to the upper roller heater 120 and the external heating roller 122 without being supplied to the belt heater 121 from the power supply section 63. This is because, in heating the fixing roller 1 and the pressure belt 5, if an electric current is also supplied to the belt heater 121 simultaneously in addition to the upper roller heater 120 and the external heating roller 122, electric power that should be supplied increases and a power supply capacity necessary for the fixing device increases.

In this case, in order to increase the temperature of the pressure belt 5, first, the control circuit section 61 lifts the pressure belt 5 with the swing mechanism 64 to bring the pressure belt 5 into press-contact with the fixing roller 1 (step S401). In such a press-contact state, the control circuit section 61 turns on the upper roller heater 120 and the heater of the external heating roller 120 by the power supply section 63 to simultaneously heat the fixing roller 1 and the pressure belt 5 (step S402). When it is detected by the first thermistor 7 that the temperature of the fixing roller 1 has reached a predetermined temperature T' (a second temperature) lower than the target temperature Tu and Tl (step S407), the control circuit section 61 rotates both the fixing roller 1 and the pressure belt 5 such that heat spreads to the entire pressure belt 5 (step S408). The external heating roller 122 rotates following the fixing roller 1.

The control circuit section 61 monitors the second thermistor 8 to judge whether the temperature of the pressure belt 5 has reached the target temperature Tl or a predetermined temperature (a first temperature) slightly lower than the target temperature Tl (step S403). This is because, since there is a difference between the target temperature Tu of the fixing roller 1 and the target temperature Tl of the pressure belt 5 and Tu is higher than Tl, if the temperature of the pressure belt 5 increases to temperature near the target temperature Tl, it is unnecessary to supply heat to the pressure belt 5 from the fixing roller 1. In step S403, when it is judged by the belt thermistor 8 that the temperature of the pressure belt 5 has reached the target temperature Tl or the predetermined temperature (the first temperature) slightly lower than the target temperature Tl, the control circuit section 61 lowers the pressure belt 5 to separate the pressure belt 5 from the fixing roller 1 (step S404).

The control circuit section 61 monitors the fixing roller thermistor 7 to judge whether the temperature of the fixing roller 1 has reached the target temperature Tu (step S405). When it is judged that the temperature of the fixing roller 1 has reached the target temperature Tu, the control circuit section 61 stops the full energization of the upper roller heater 120 and the heater of the external heating roller 122. The control circuit section 61 also starts energization of the belt heater 121 to switch the temperature control to temperature control (usual temperature control) in the standby state (step S406). Since the temperature of the fixing roller 1 has reached the target temperature Tu, the fixing device comes into the standby state.

In the usual temperature control in the standby state, the control circuit section 61 controls energization of each of the upper roller heater 120 and the belt heater 121 according to, for example, PWM control or time division control such that the fixing roller 1 and the pressure belt 5 maintain the respective target temperatures.

Figure 5:
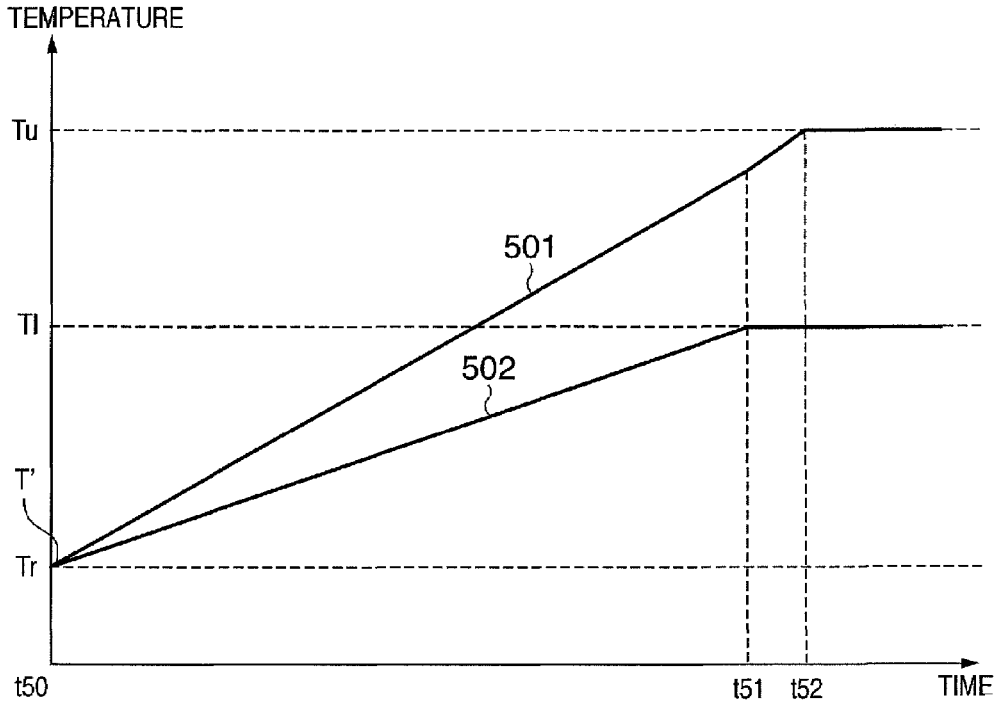
FIG. 5 is a graph showing changes in temperatures of a fixing roller and a pressure belt in the case in which the temperatures are controlled on the basis of the flowchart of FIG. 4.

FIG. 5 is a graph showing changes in temperatures of the fixing roller 1 and the pressure belt 5 in the case in which the temperatures are controlled on the basis of the flowchart of FIG. 4. The ordinate represents temperature and the abscissa represents time. On the ordinate, Tr indicates a room temperature (an environmental temperature), T' indicates a temperature at which the heating roller 1 and the pressure belt 5 start their rotations, Tl indicates a target temperature of the pressure belt 5, and Tu indicates a target temperature of the fixing roller 1. Reference numeral 501 denotes the temperature of the fixing roller 1 detected by the first thermistor 7 and 502 denotes the temperature of the pressure belt 5 detected by the second thermistor 8.

At a point t50 when the power supply for the fixing device 40 is turned on, both the temperatures of the fixing roller 1 and the pressure belt 5 are the room temperature Tr. In such a state in which the fixing roller 1 and the pressure belt 5 are brought into press-contact with each other, full energization of the upper roller heater 120 and the heater of the external heating roller 122 is started, and if the temperature becomes the predetermined temperature T' the pressure belt 5 is driven to rotate. Consequently, the temperatures of the fixing roller 1 and the pressure belt 5 gradually increase. The target temperature Tu of the fixing roller 1 and the target temperature Tl of the pressure belt 5 are different and in a relation of Tu>Tl. The temperature 502 of the pressure belt 5 increases more gently than the temperature 501 of the fixing roller 1.

At a point T51 when the temperature 502 of the pressure belt 5 has reached the target temperature Tl or a temperature (a first temperature) near the target temperature Tl, the pressure belt 5 is separated from the fixing roller 1. Consequently, the temperature of the pressure belt 5 does not increase exceeding the target temperature Tl. On the other hand, since heat from the upper roller heater 120 and the heater of the external heating roller 122 is applied only to the fixing roller 1, the temperature 501 of the fixing roller 1 rapidly increases from the point t51. At a point t52 when the temperature 501 of the fixing roller 1 has reached the target temperature Tu, the fixing device 40 comes into the standby state. Energization of each of the upper roller heater 120 and the belt heater 121 is controlled such that the fixing roller 1 and the pressure belt 5 maintain the respective target temperatures Tu and Tl.

Figure 6:
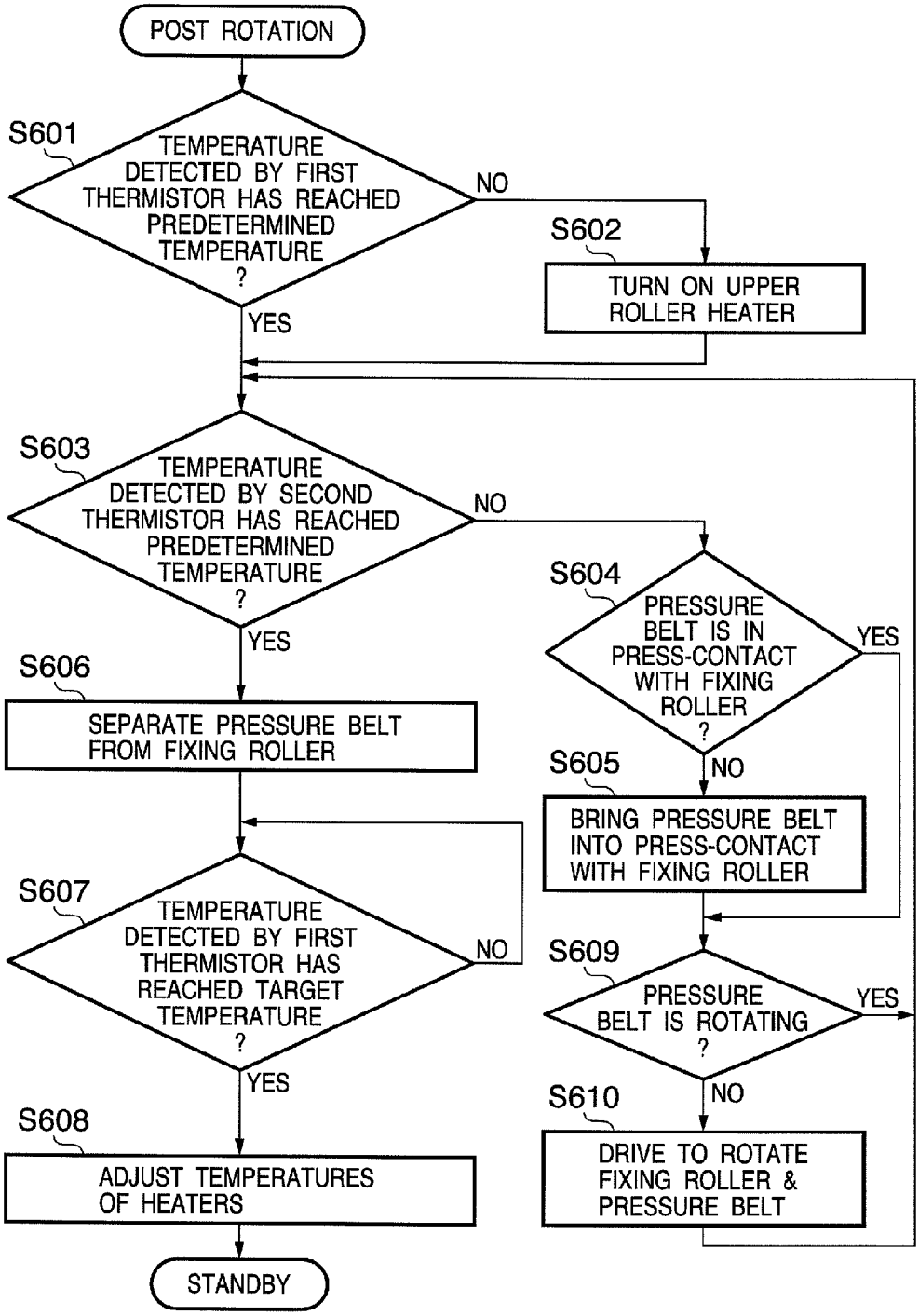
FIG. 6 is a flowchart showing processing concerning temperature control after execution of a fixing operation in the fixing device applied to the image forming apparatus according to the first embodiment.

FIG. 6 is a flowchart showing processing concerning temperature control after executing the fixing operation in the fixing device 40 of the image forming apparatus according to this embodiment. When the fixing operation ends, a main body of the fixing device 40 comes into a state called post rotation (post processing). The fixing roller 1 and the pressure belt 5 continue to be in the press-contact state.

First, the control circuit section 61 monitors the first thermistor 7 to judge whether the temperature of the fixing roller 1 has reached a predetermined temperature slightly lower than the target temperature Tu (step S601). The fixing roller 1 and the pressure belt 5 are deprived of heat by the recording medium P because of the fixing operation. Therefore, the temperatures of the fixing roller 1 and the pressure belt 5 usually fall at the time of the post rotation. If the temperature of the fixing roller 1 has not reached the predetermined temperature, considering that the temperature of the pressure belt 5 has also fallen to be lower than the target temperature Tl, the control circuit section 61 controls the temperatures of the fixing roller 1 and the pressure belt 5 to increase to the respective target temperatures Tu and Tl. In post rotation processing, as in the warm-up processing described above, the control circuit section 61 performs full energization for supplying electric power only to the upper roller heater 120 and the heater of the external heating roller 122 (step S602).

The control circuit section 61 monitors the second thermistor 8 to judge whether the temperature of the pressure belt 5 has reached the target temperature Tl or a predetermined temperature slightly lower than the target temperature Tl (step S603). This is because, as described above, since the target temperature Tl of the pressure belt 5 is lower than the target temperature Tu of the fixing roller 1, if the temperature of the pressure belt 5 increases to temperature near the target temperature Tl, it is unnecessary to supply heat to the pressure belt 5 from the fixing roller 1.

In step S603, if the temperature of the pressure belt 5 has not reached the target temperature Tl or the predetermined temperature (the first temperature) slightly lower than the target temperature Tl, the control circuit section 61 judges whether the pressure belt 5 and the fixing roller 1 are in press-contact with each other (step S604). Usually, the pressure belt 5 is in press-contact with the fixing roller 1. However, when it is judged that the pressure belt 5 is not in press-contact with the fixing roller 1 because of some reason, the control circuit section 61 lifts the pressure belt 5 to bring the pressure belt 5 into press-contact with the fixing roller 1 and transmit heat of the fixing roller 1 to the pressure belt 5 (step S605). In this case, the control circuit section 61 further judges whether the pressure belt 5 is rotating (step S609). If the pressure belt 5 is not rotating, the control circuit section 61 drives to rotate the fixing roller 1 and the pressure belt 5 such that the heat of the fixing roller 1 is transmitted to the entire pressure belt 5 (step S610).

On the other hand, when it is judged in step S603 that the temperature of the pressure belt 5 has reached the target temperature Tl or the predetermined temperature slightly lower than the target temperature Tl, the control circuit section 61 lowers the pressure belt 5 to separate the pressure belt 5 from the fixing roller 1 (step S606). The control circuit section 61 monitors the first thermistor 7 to judge whether the temperature of the fixing roller 1 has reached the target temperature Tu (step S607). When it is judged that the temperature of the fixing roller 1 has reached the target temperature Tu, the control circuit section 61 stops the full energization of the upper roller heater 120 and the heater of the external heating roller 122. The control circuit section 61 also starts energization of the belt heater 121 to switch the temperature control to the usual temperature control in the standby state (step S608). Since the temperatures of the fixing roller 1 and the pressure belt 5 have reached the target temperatures Tu and Tl, the fixing device 40 comes into the standby state.

Figure 7:
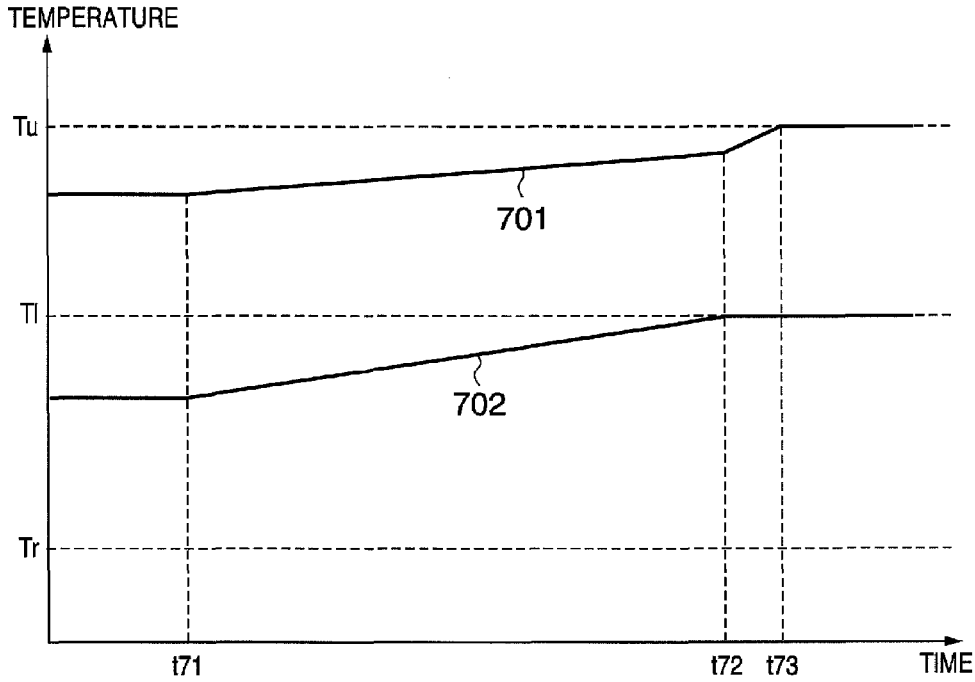
FIG. 7 is a graph showing changes in temperatures of the fixing roller and the pressure belt in the case in which the temperatures are controlled on the basis of the flowchart of FIG. 6.

FIG. 7 is a graph showing, as in FIG. 5, changes in the temperatures of the fixing roller 1 and the pressure belt 5 in the case in which the temperatures are controlled on the basis of the flowchart of FIG. 6. On the ordinate, Tr indicates a room temperature (an environmental temperature), Tl indicates a target temperature of the pressure belt 5, and Tu indicates a target temperature of the fixing roller 1. Reference numeral 701 denotes the temperature of the fixing roller 1 detected by the first thermistor 7 and 702 denotes the temperature of the pressure belt 5 detected by the second thermistor 8.

At a point T71 when the fixing operation ends, since the fixing roller 1 and the pressure belt 5 are deprived of heat by the recording medium P, both the temperatures of the fixing roller 1 and the pressure belt 5 fall to be lower than the target temperatures Tu and Tl corresponding thereto. When the post rotation processing is started, the upper roller heater 120 and the heater of the external heating roller 122 are energized. The fixing roller 1 and the pressure belt 5 are driven to rotate in a state in which the fixing roller 1 and the pressure belt 5 are in press-contact with each other. Therefore, the temperature 701 of the fixing roller 1 and the temperature 702 of the pressure belt 5 gradually increase.

At a point t72 when the temperature 702 of the pressure belt 5 has reached the target temperature Tl or a predetermined temperature (a first temperature) slightly lower than the target temperature Tl, the pressure belt 5 is separated from the fixing roller 1. Consequently, the temperature of the pressure belt 5 does not increase exceeding the target temperature Tl. On the other hand, since heat from the upper roller heater 120 and the heater of the external heating roller 122 is applied only to the fixing roller 1, the temperature 701 of the fixing roller 1 more rapidly increases from the time t72. At a point t73 when the temperature 701 of the fixing roller 1 has reached the target temperature Tu, the fixing device 40 comes into the standby state. Energization of each of the upper roller heater 120 and the belt heater 121 is controlled such that the fixing roller 1 and the pressure belt 5 maintain the respective target temperatures Tu and Tl.

As explained above, according to this embodiment, the temperatures of the fixing roller 1 and the pressure belt 5 are controlled to increase to the target temperatures Tu and Tl only with the upper roller heater 120 and the heater of the external heating roller 122. In increasing the temperatures of the fixing roller 1 and the pressure belt 5, both the fixing roller 1 and the pressure belt 5 are brought into the press-contact state and driven to rotate. Therefore, complicated control for the heaters is made unnecessary to make it possible to efficiently increase the temperature of the entire pressure belt 5 and reduce time until the fixing device 40 comes into the standby state.

Second Embodiment

A second embodiment of the fixing device 40 in the image forming apparatus according to the invention will be hereinafter explained. In the following description, explanations of parts same as those in the first embodiment will be omitted and characteristic parts of the second embodiment will be mainly explained.

The fixing device 40 in the image forming apparatus according to the second embodiment is the same as that in the first embodiment in a structure and an image forming apparatus to which the fixing device 40 is applicable. However, processing concerning temperature control in warm-up and post rotation is different from that in the first embodiment.

Figure 8:
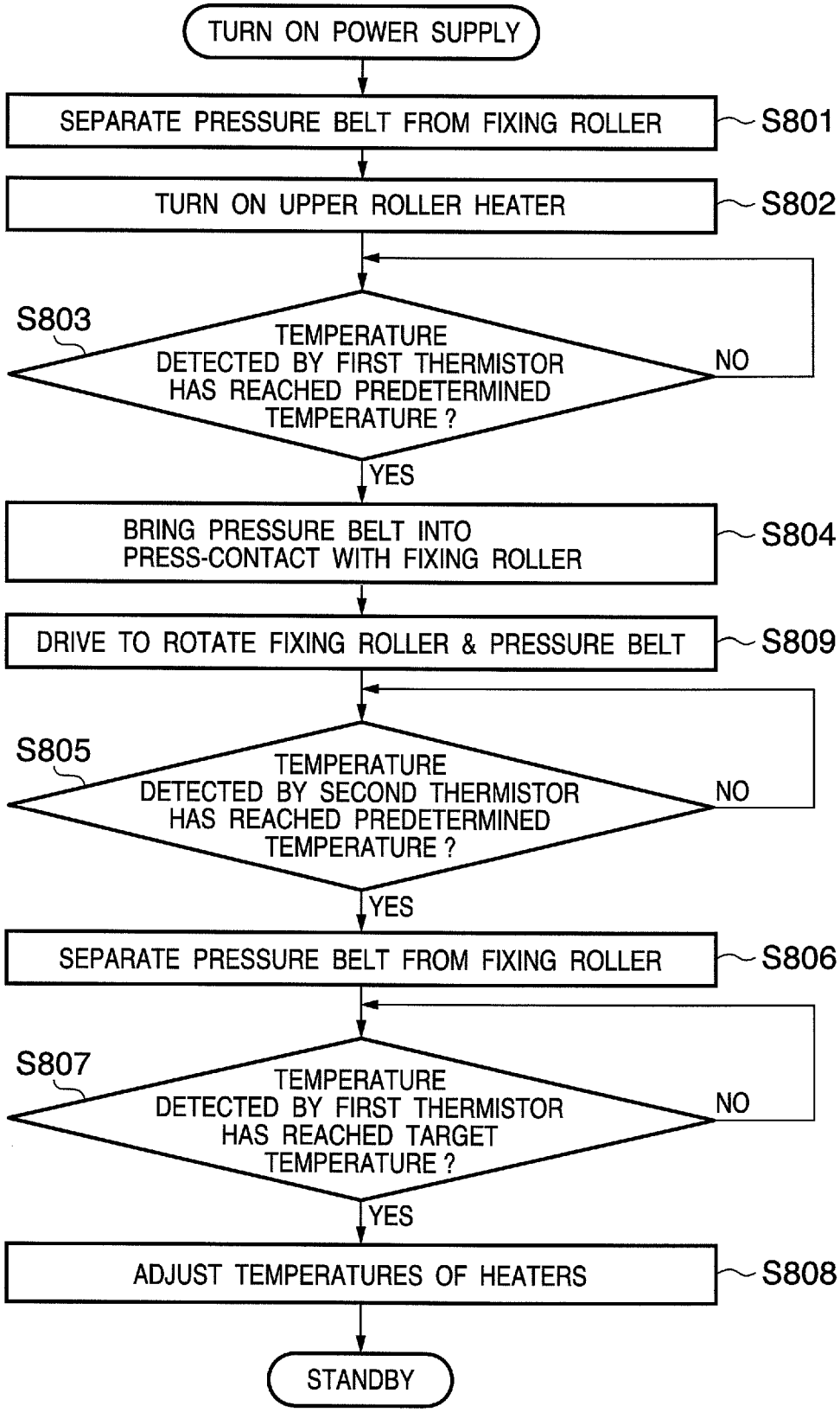
FIG. 8 is a flowchart showing processing concerning temperature control at the time of warm-up after turning on a power supply in a fixing device applied to an image forming apparatus according to a second embodiment.

FIG. 8 is a flowchart showing processing concerning temperature control at the time of warm-up after turning on a power supply in the fixing device 40 in the image forming apparatus according to this embodiment. In this embodiment, taking into the fact that, as time during which the pressure belt 5 is in press-contact with the fixing roller 1 is longer, durabilities of both the pressure belt 5 and the fixing roller 1 are shorter, time during which both the pressure belt 5 and the fixing roller 1 are in a press-contact state is controlled to be short.

When the power supply is turned on and the fixing device 40 is started, the control circuit section 61 starts control for separating the pressure belt 5 and increasing the temperatures of the fixing roller 1 and the pressure belt 5 to the respective target temperatures Tu and Tl. In this embodiment, as in the first embodiment, electric power is supplied only to the upper roller heater 120 and the heater of the external heating roller 122 without being supplied to the belt heater 121. Moreover, in this embodiment, in order to reduce time during which the pressure belt 5 and the fixing roller 1 are heated in the press-contact state from the viewpoint of durabilities, the control circuit section 61 lowers the pressure belt 5 to separate the pressure belt 5 from the fixing roller 1 (step S801).

The control circuit section 61 turns on the upper roller heater 120 and the heater of the external heating roller 122 to increase the temperature of the fixing roller 1 (step S802). When it is detected by the thermistor 7 that the temperature of the fixing roller 1 has reached a predetermined temperature T" (the second temperature) slightly lower than the target temperature Tu (step S803), in order to increase the temperature of the pressure belt 5, the control circuit section 61 lifts the pressure belt 5 to bring the pressure belt 5 into press-contact with the fixing roller 1 (step S804). The control circuit section 61 rotates both the fixing roller 1 and the pressure belt 5 such that heat spreads to the entire pressure belt 5 (step S809). The external heating roller 122 rotates following the fixing roller 1.

The control circuit section 61 monitors the thermistor 8 to judge whether the temperature of the pressure belt 5 has reached the target temperature Tl or the predetermined temperature (the first temperature) slightly higher than the target temperature Tl (step S805). This is because, since there is a difference between the target temperature Tu of the fixing roller 1 and the target temperature Tl of the pressure belt 5 and Tu is higher than Tl, if the temperature of the pressure belt 5 increases to temperature near the target temperature Tl, it is unnecessary to supply heat to the pressure belt 5 from the fixing roller 1. When it is judged by the thermistor 8 in step S805 that the temperature of the pressure belt 5 has reached the target temperature Tl or the predetermined temperature slightly lower than the target temperature Tl, the control circuit section 61 lowers the pressure belt 5 to separate the pressure belt 5 from the fixing roller 1 (step S806).

The control circuit section 61 monitors the thermistor 7 to judge whether the temperature of the fixing roller 1 has reached the target temperature Tu (step S807). When it is judged that the fixing roller 1 has reached the target temperature Tu, the control circuit section 61 stops the full energization of the upper roller heater 120 and the heater of the external heating roller 122, also starts energization of the belt heater 121, and switches the temperature control to the usual temperature control in the standby state (step S808). Since the temperature of the fixing roller 1 has reached the target temperature Tu, the fixing device 40 comes into the standby state. In the usual temperature control in the standby state, for example, the control circuit section 61 controls energization of each of the upper roller heater 120 and the belt heater 121 according to, for example, PWM control or time division control such that the fixing roller 1 and the pressure belt 5 maintain the respective target temperatures Tu and Tl.

Figure 9:
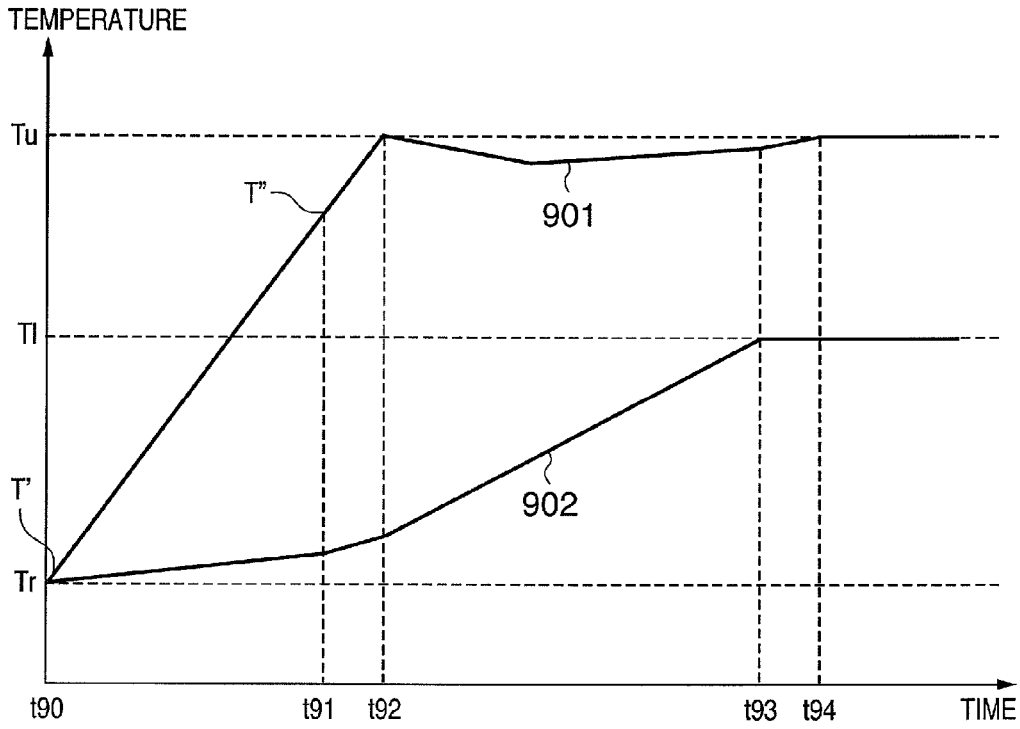
FIG. 9 is a graph showing changes in temperatures of a fixing roller and a pressure belt in the case in which the temperatures are controlled on the basis of the flowchart of FIG. 8.

FIG. 9 is a graph showing, as in FIG. 5, changes in the temperatures of the fixing roller 1 and the pressure belt 5 in the case in which the temperatures are controlled on the basis of the flowchart of FIG. 8. The ordinate represents temperature and the abscissa represents time. On the ordinate, Tr indicates a room temperature (an environmental temperature), Tl indicates a target temperature of the pressure belt 5, T" is a temperature to press-contact the pressure belt 5 with the fixing roller 1, and Tu indicates a target temperature of the fixing roller 1. Reference numeral 901 denotes the temperature of the fixing roller 1 detected by the thermistor 7 and 902 denotes the temperature of the pressure belt 5 detected by the thermistor 8.

At a point t90 when the power supply for the fixing device is turned on, both the temperatures of the fixing roller 1 and the pressure belt 5 are the room temperature Tr. In a state in which the fixing roller 1 and the pressure belt 5 are separated, full energization of the upper roller heater 120 and the heater of the external heating roller 122 is started and the temperature of the fixing roller 1 gradually increases. At this point, the temperature of the pressure roller 5 also increases slightly because of heat radiated from the fixing roller 1.

At a point t91 when the temperature of the fixing roller 1 has reached the predetermined temperature T" (the second temperature) slightly lower than the target temperature Tu, the pressure belt 5 is lifted to be brought into press-contact with the fixing roller 1. At a point t92, the pressure belt 5 and the fixing roller 1 comes into the press-contact state. Consequently, since the fixing roller 1 is deprived of heat by the pressure belt 5, the temperature temporarily falls. The pressure belt 5 and the fixing roller 1 are driven to rotate in the press-contact state. Consequently, heat is transmitted to the pressure belt 5 from the fixing roller 1 and the temperature of the entire pressure belt 5 gradually increases.

At a point t93 when the temperature of the pressure belt 5 has reached the temperature (a first temperature) near the target temperature Tl, the pressure belt 5 starts an operation for separating from the fixing roller 1. Consequently, the temperature of the pressure belt 5 does not increase exceeding the target temperature Tl. On the other hand, since the upper roller heater 120 and the heater of the external heating roller 122 continue to be in the turned on state, the temperature of the fixing roller 1 increases and reaches temperature near the target temperature Tu at a point t94. The fixing device 40 comes into the standby state. Energization of each of the upper roller heater 120 and the belt heater 121 is controlled such that the fixing roller 1 and the pressure belt 5 maintain the respective target temperatures Yu and Tl.

Figure 10:
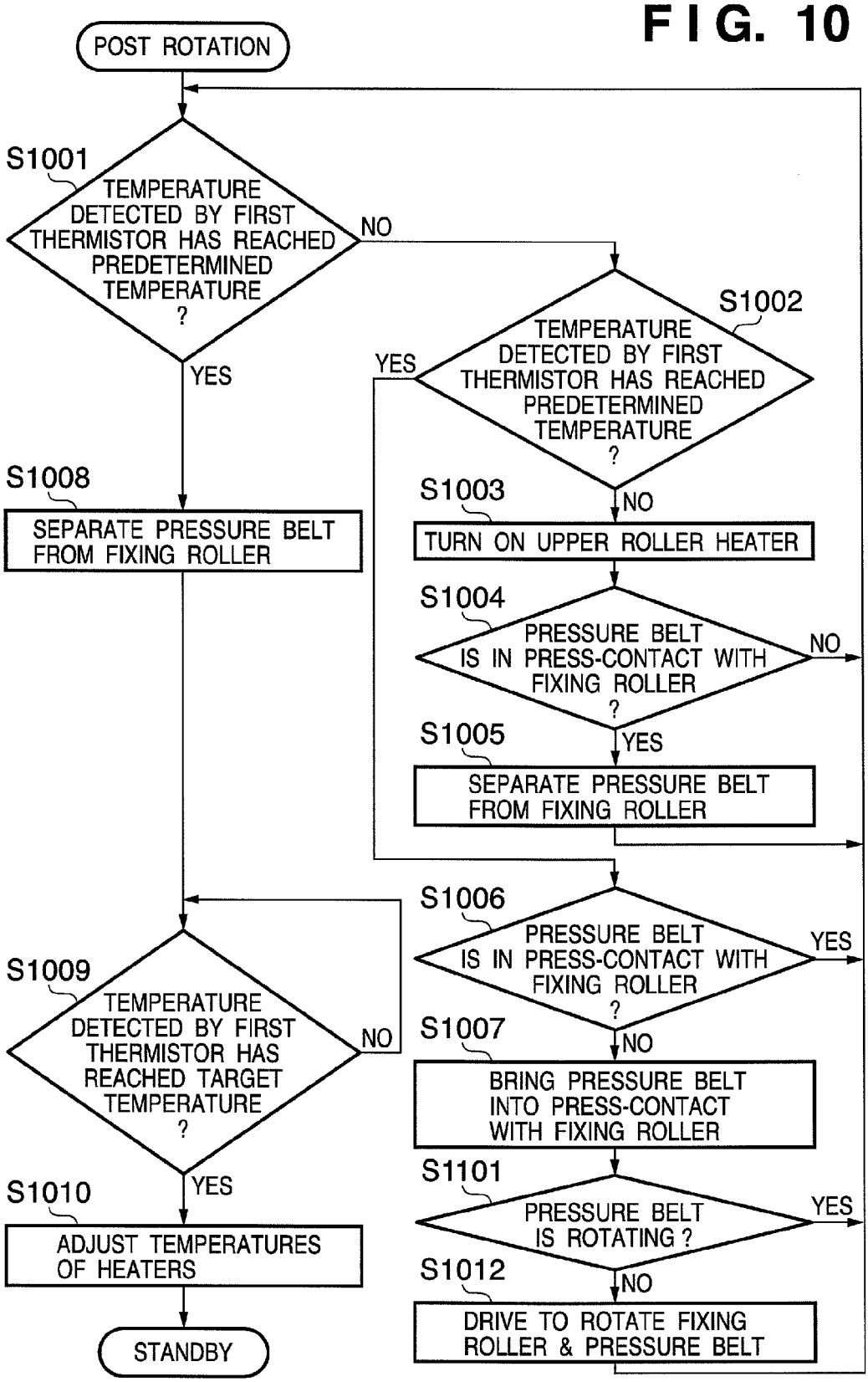
FIG. 10 is a flowchart showing processing concerning temperature control after execution of a fixing operation in the fixing device applied to the image forming apparatus according to the second embodiment.

FIG. 10 is a flowchart showing processing concerning temperature control after executing a fixing operation in the fixing device 40 of the image forming apparatus according to this embodiment. When the fixing operation ends, a main body of the fixing device 40 comes into a state called post rotation (post processing). The fixing roller 1 and the pressure roller 5 continue to be in the press-contact state. Even in this post rotation, in this embodiment, the control circuit section 61 controls time during which the pressure belt 5 and the fixing roller 1 are in the press-contact state to be short taking into account durabilities of both the pressure belt 5 and the fixing roller 1.

First, the control circuit section 61 monitors the thermistor 8 to judge whether the temperature of the pressure belt 5 has reached the target temperature Tl (step S1001). Since the fixing roller 1 and the pressure belt 5 are deprived of heat by the recording medium P because of the fixing operation, usually, the temperatures of the fixing roller 1 and the pressure belt 5 fall at the time of the post rotation. If the temperature of the pressure belt 5 has not reached the target temperature Tl, the control circuit section 61 monitors the thermistor 7 to judge whether the temperature of the fixing roller 1 has reached the predetermined temperature (the second temperature) slightly lower than the target temperature Tu (step S1002).

If the temperature of the fixing roller 1 has not reached the predetermined temperature, the control circuit section 61 controls the temperatures of the fixing roller 1 and the pressure belt 5 to increase to the respective target temperatures Yu and Tl. In the post rotation processing, as in the warm-up processing, the control circuit section 61 performs full energization for supplying electric power only to the upper roller heater 120 and the heater of the external heating roller 122 (step S1003).

Since it is desired not to heat the pressure belt 5 and the fixing roller 1 in the press-contact state from the viewpoint of durabilities as much as possible, the control circuit section 61 judges whether the pressure belt 5 is in the press-contact state (step S1004). If the pressure belt 5 and the fixing roller 1 are in the press-contact state, the control circuit section 61 lowers the pressure belt 5 to separate the pressure belt 5 from the fixing roller 1 (step S1005).

If the temperature of the fixing roller 1 has reached the predetermined temperature in step S1002, the control circuit section 61 judges whether the pressure belt 5 is in press-contact with the fixing roller 1 (step S1006). If the temperature of the fixing roller 1 has not reached the predetermined temperature T" (the third temperature) in step S1002, the control circuit section 61 lifts the pressure belt 5 to bring the pressure belt 5 into press-contact with the fixing roller 1 in order to transmit heat to the pressure belt 5 (step S1007). The control circuit section 61 judges whether the pressure belt 5 is rotating (step S1011). If the pressure belt 5 is not rotating, the control circuit section 61 drives to rotate the fixing roller 1 and the pressure belt 5 such that heat from the fixing roller 1 is transmitted to the entire pressure belt 5 (step S1012).

When it is judged NO in step S1004 and when it is judged YES in step S1006 and step S1011, the control circuit section 61 returns the processing to step S1001 after step S1005 and step S1012.

When it is judged in step S1001 that the pressure belt 5 has reached the target temperature Tl or the predetermine temperature (the first temperature) slightly lower than the target temperature Tl, the control circuit section 61 lowers the pressure belt 5 to separate the pressure belt 5 from the fixing roller 1 (step S1008). This is because, as described above, since the target temperature Tl of the pressure belt 5 is lower than the target temperature Tu of the fixing roller 1, if the temperature of the pressure belt 5 increases to the predetermined temperature, it is unnecessary to supply heat to the pressure belt 5 from the fixing roller 1.

The control circuit section 61 monitors the first thermistor 7 to judge whether the temperature of the fixing roller 1 has reached the target temperature Tu (step S1009). When it is judged that the fixing roller 1 has reached the target temperature Tu, the control circuit section 61 stops the full energization of the upper roller heater 120 and the heater of the external heating roller 122, also starts energization of the belt heater 121, and switches the temperature control to the usual temperature control in the standby state (step S1010). Since the temperatures of the fixing roller 1 and the pressure belt 5 have reached the target temperatures Tu and Tl, the fixing device 40 comes into the standby state.

Figure 12:
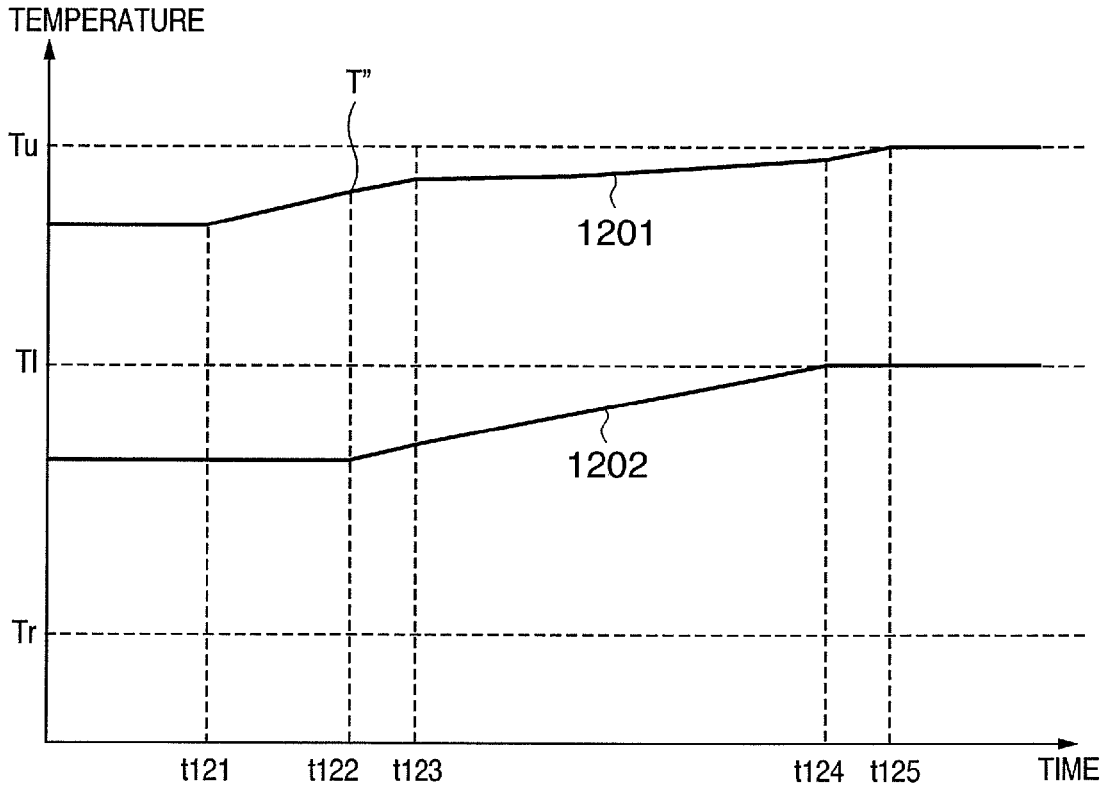
FIG. 12 is a graph showing changes in temperatures of the fixing roller and the pressure belt in the case in which the temperatures are controlled on the basis of the flowchart of FIG. 10.

FIG. 12 is a diagram showing, as in the FIG. 9, changes in the temperatures of the fixing roller 1 and the pressure belt 5 in the case in which the temperatures are controlled on the basis of the flowchart of FIG. 10. On the ordinate, Tr indicates a room temperature (an environmental temperature), Tl indicates a target temperature of the pressure belt 5, and Tu indicates a target temperature of the fixing roller 1. Reference numeral 1201 denotes the temperature of the fixing roller 1 detected by the first thermistor 7 and 1202 denotes the temperature of the pressure belt 5 detected by the second thermistor 8.

At a point t121 when the fixing operation ends, since the fixing roller 1 and the pressure belt 5 are deprived of heat by the recording medium P, the temperatures of both the fixing roller 1 and the pressure belt 5 fall to be lower than the target temperatures Tu and Tl corresponding thereto. When the post rotation processing is started, the upper roller heater 120 and the heater of the external heating roller 122 are turned on, the fixing roller 1 is heated in a state in which the pressure belt 5 is separated, and the temperature 1201 gradually increases.

At a point t122 when the temperature 1201 of the fixing roller 1 has reached the predetermined temperature T" slightly lower than the target temperature Tu, the pressure belt 5 is lifted to be brought into press-contact with the fixing roller 1. At a point t123, the pressure belt 5 and the fixing roller 1 come into the press-contact state. Since the pressure belt 5 and the fixing roller 1 are driven to rotate in the press-contact state, the increase of the temperature 1201 of the fixing roller temporarily weakens. On the other hand, the temperature 1202 of the pressure belt 5 gradually increases because of heat transmitted from the fixing roller 1.

The target temperature Tl of the pressure belt 5 is lower than the target temperature Tu of the fixing roller 1. At a point t124 when the temperature 1202 of the pressure belt 5 has reached temperature near the target temperature Tl, the pressure belt 5 is separated from the fixing roller 1. Consequently, the temperature of the pressure belt 5 does not increase exceeding the target temperature Tl. On the other hand, heat from the upper roller heater 120 and the heater of the external heating roller 122 is applied only to the fixing roller 1. Therefore, the temperature 1201 of the fixing roller 1 more rapidly increases from time t124. At a point t125 when the temperature 1201 of the fixing roller 1 has reached the target temperature Tu, the fixing device 40 comes into the standby state and the energization of each of the upper roller heater 120 and the belt heater 121 is controlled such that the fixing roller 1 and the pressure belt 5 maintain the respective target temperatures Tu and Tl.

As explained above, according to this embodiment, the control circuit section 61 controls the temperatures of the fixing roller 1 and the pressure belt 5 to increase to the target temperatures only with the upper roller heater 120 and the heater of the external heating roller 122. The control circuit section 61 controls time during which the fixing roller 1 and the pressure belt 5 are in the press-contact state to be reduced. Therefore, while durabilities of the fixing roller 1 and the pressure belt 5 are taken into account, complicated control for the heaters is made unnecessary to make it possible to efficiently increase the temperature of the entire pressure belt 5 and reduce time until the fixing device 40 comes into the standby state.

Third Embodiment

A third embodiment of the fixing device 40 of the image forming apparatus according to the invention will be hereinafter explained. In the following explanation, parts same as those in the first embodiment will be omitted and characteristic parts of the third embodiment will be mainly explained.

The fixing device 40 of the image forming apparatus according to the third embodiment is the same as that in the first embodiment in a structure and an image forming apparatus to which the fixing device 40 is applicable. However, processing concerning control at the time of start of fixing temperature adjustment is different from that in the first embodiment.

Figure 13:
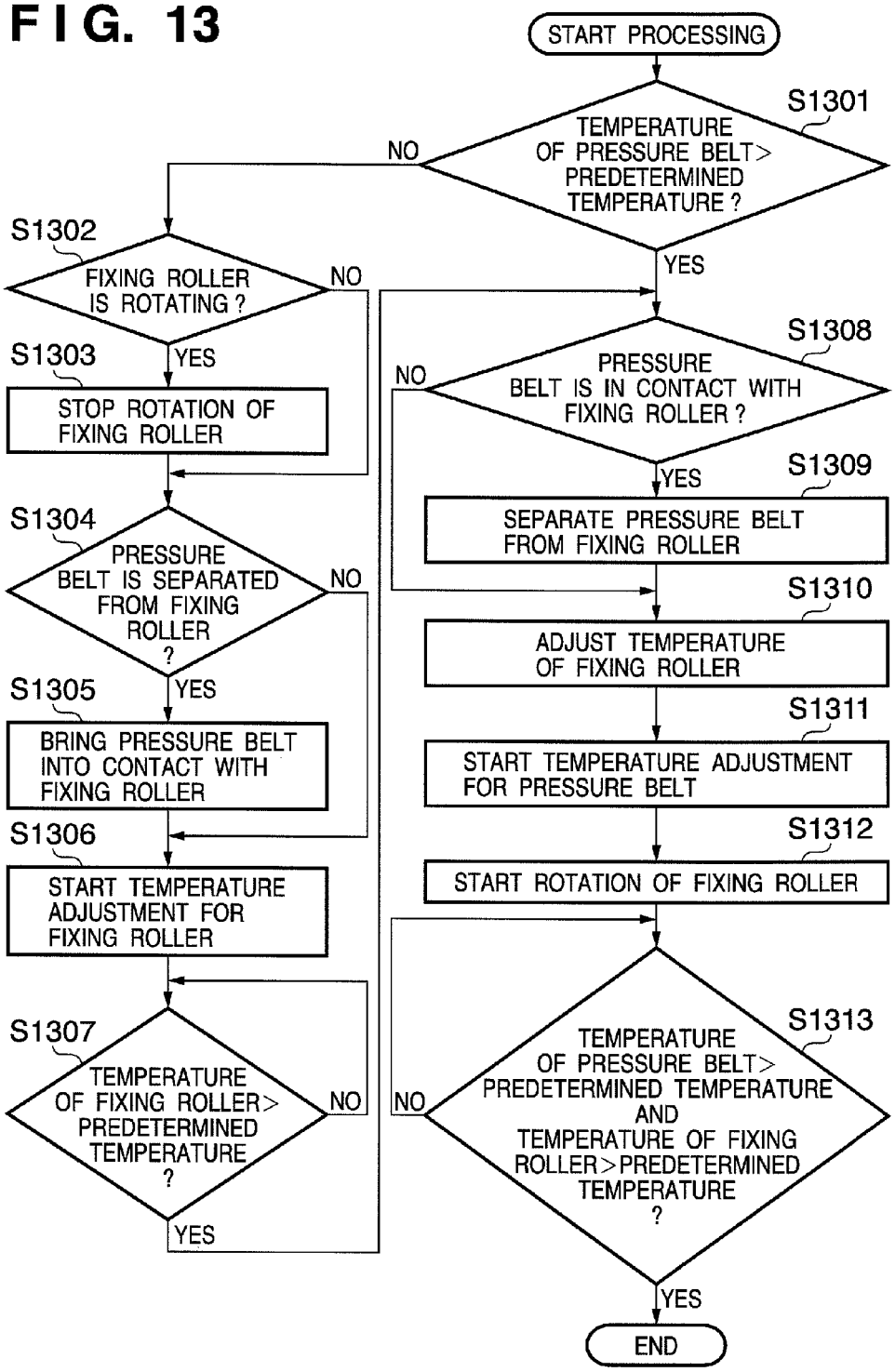
FIG. 13 is a flowchart showing processing concerning temperature control after execution of a fixing operation in a fixing device applied to an image forming apparatus according to a third embodiment.

FIG. 13 is a flowchart of processing concerning temperature control of the fixing device 40 after turning on a power supply, at the time of return from an energy saving mode, and the like. In this embodiment, the control circuit section 61 controls time during which the fixing device 40 is in a press-contact state to be short taking into account the temperature of the pressure belt 5 at the time of start of temperature control.

When the power supply is turned on and the fixing device 40 is started, the control circuit section 61 judges whether the temperature of the pressure belt 5 is equal to or higher than a first temperature slightly lower than a target temperature Tl of the pressure belt 5, specifically, equal to or higher than 100 degrees Celsius (step S1301). When it is judged by the thermistor 8 in step S1301 that the temperature of the pressure belt 5 is lower than the first temperature slightly lower than the target temperature Tl, the control circuit section 61 judges whether the fixing roller 1 is rotating (step S1302). If the fixing roller 1 is rotating, the control circuit section 61 stops the rotation (step S1303). If the fixing roller 1 is not rotating, the control circuit section 61 judges whether the pressure belt 5 is separated from the fixing roller 1 (step S1304).

When it is judged in step S1304 that the pressure belt 5 is separated from the fixing roller 1, the control circuit section 61 brings the pressure belt 5 into contact with the fixing roller 1 (step S1305). When it is judged in step S1304 that the pressure belt 5 is in contact with the fixing roller 1, the control circuit section 61 turns on the upper roller heater 120 and the heater of the external heating roller 122 of the fixing device 40 to increase the temperature of the fixing roller 1 (step S1306).

When it is detected by the thermistor 7 that the temperature of the fixing roller 1 has reached a predetermined temperature (specifically, increases to be higher than 100 degrees Celsius) (step S1307), the control circuit section 61 proceeds the processing to step S1308. This makes it possible to surely eliminate temperature unevenness in a conveying direction of the recording medium P in the pressing member 46.

The control circuit section 61 judges whether the pressure belt 5 is in contact with the fixing roller 1 (step S1308). When the pressure belt 5 is not in contact with the fixing roller 1, the control circuit section 61 directly perform temperature adjustment for the fixing roller 1 (step S1310). When the pressure belt 5 is in contact with the fixing roller 1, the control circuit section 61 lowers the pressure belt 5 to separate the pressure belt 5 from the fixing roller 1 (step S1309). Thereafter, the control circuit section 61 performs temperature adjustment for the fixing roller 1 (step S1310). This is because, since the target temperature Tl of the pressure belt 5 is lower than the target temperature Tu of the fixing roller 1, if the temperature of the pressure belt 5 increases to a predetermined temperature, it is unnecessary to supply heat to the pressure belt 5 from the fixing roller 1.

Thereafter, the control circuit section 61 starts temperature adjustment for the pressure belt 5 (step S1311). The control circuit section 61 rotates the fixing roller 1 temporarily stopped for separation again (step S1312). This makes it possible to surely perform temperature adjustment control in fixing an image on the recording medium P.

Thereafter, when the temperature of the pressure belt 5 exceeds the target temperature Tl (e.g., 110 degrees Celsius) and the temperature of the fixing roller 1 exceeds the target temperature Tu (e.g., 160 degrees Celsius) (YES in step S1313), the control circuit section 61 ends this processing.

According to the processing of the third embodiment shown in FIG. 13, when the temperature of the pressure belt 5 is lower than the predetermined temperature (100 degrees Celsius) at the time of start of the fixing device 40 (NO in step S1301), the control circuit section 61 stops the rotation of the fixing roller 1 (steps S1302 and S1303). After bringing the fixing roller 1 and the pressure belt 5 into contact with each other (steps S1304 and S1305), the control circuit section 61 starts heating of the fixing roller 1 according to control of the upper roller heater 120 (step S1306). This makes it possible to eliminate temperature unevenness in the conveying direction of the recording medium P in the pressing member 46, which is in contact with the pressure belt 5, and prevent an image failure from occurring in an image printed on the recording medium P.

Other Embodiments

The embodiments of the invention have been described in detail. However, the invention may be applied to a system constituted by plural apparatuses or may be applied to an image forming apparatus consisting of one device.

A recording system to which the fixing device of the image forming apparatus according to the invention is applied may be the electrophotographic system or may be the sublimation type or the thermal transfer type. An apparatus or a system to which the fixing device according to the invention is applied may be apparatuses (e.g., a multifunction peripheral) other than the image forming apparatus explained above.

In the embodiments described above, the structure of the fixing device of the image forming apparatus according to the invention is explained with the structure including the fixing roller on the upper side and the pressure belt on the lower side as the pressing members as an example. However, it is possible to apply the invention to other structures as long as a belt is used as one of upper and lower two pressing members.

The invention can also be attained by supplying a program of software for realizing the functions of the embodiments to a system or an apparatus directly or from a remote location and a computer of the system or the apparatus reading out and executing the program supplied. In the embodiments, what attains the invention is a program corresponding to the flowcharts of FIGS. 4, 6, 8, 10, and 13. In that case, its form does not have to be a program as long as it has functions of the program.

Therefore, in order to realize the functional processing of the invention with a computer, a program code itself installed in the computer also realizes the invention. In other words, a computer program itself for realizing the functional processing of the invention is included in the scope of the invention.

In that case, a form of the program may be any form such as an object code, a program executed by an interpreter, or script data supplied to an OS as long as it has the functions of the program.

As a storage medium for supplying the program, it is possible to use various media. The media include a floppy (registered trademark) disk, a hard disk, an optical disk, a magneto-optical disk, an MO, a CD-ROM, a CD-R, a CD-RW, a magnetic tape, a nonvolatile memory card, a ROM, and a DVD (a DVD-ROM or a DVD-R).

Besides, as a method of supplying the program, it is also possible to supply the program by making connection to a Web page on the Internet using a browser of a client computer and downloading the program to a storage medium such as a hard disk. In that case, what is downloaded may be the computer program itself of the invention or a file compressed and including an automatic install function.

It is also possible to realize the functional processing of the invention by dividing the program code constituting the program of the invention into plural files and downloading the respective files from different Web pages. In other words, a WWW server that causes plural users to download a program file for realizing the functional processing of the invention with a computer is also included in the scope of the invention.

The program of the invention may be encrypted and stored in a storage medium such as a CD-ROM to be distributed to users. In that case, users who meet predetermined conditions download key information for decryption from a Web page via the Internet and use the key information. Consequently, the encrypted program is installed in a computer in an executable form.

When the computer executes the program read out, it is possible to realize the functions of the embodiments in a form other than the forms in which the functions are realized. For example, an OS or the like running on the computer performs a part or all of actual processing on the basis of an instruction of the program. The functions of the embodiments can be realized by the processing.

Moreover, the program read out from the storage medium may be written in a memory included in a function extending board inserted in the computer or a function extending unit connected to the computer. In this case, thereafter, a CPU or the like included in the function extending board or the function extending unit performs a part or all of actual processing on the basis of an instruction of the program. The functions of the embodiments are realized by the processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2005-264427 filed Sep. 12, 2005, 2005-266038 filed Sep. 13, 2005 and 2006-240794 filed Sep. 5, 2006 which are hereby incorporated by reference herein in their entirety.

What is claimed is:

1. An image forming apparatus comprising:

an image forming unit that forms an image on a recording medium;

a heating member and a pressing member that form a nip section to heat and press the image formed on the recording medium;

a separating mechanism that separates the heating member and the pressing member; and a first temperature detecting unit that detects temperature of the pressing member, wherein in forming the nip section with the heating member and the pressing member to heat the heating member to a target temperature, when a detected temperature of the pressing member reaches a first temperature lower than the target temperature of the heating member, the heating member and the pressing member are separated from each other.

2. The image forming apparatus according to claim 1, further comprising:

a second temperature detecting unit that detects temperature of the heating member, wherein in case of heating the heating member to the target temperature of the heating member, if a detected temperature of the pressing member reaches a second temperature lower than the first temperature after forming the nip section with the heating member and the pressing member, rotational drive for the heating member and the pressing member is started.

3. The image forming apparatus according to claim 1, wherein incase of heating the heating member to the target temperature of the heating member after a power supply for the image forming apparatus is turned on, the heating member and the pressing member are separated from each other by the separating mechanism, and if a detected temperature of the heating member reaches a third temperature lower than the target temperature of the heating member and higher than the first temperature, the heating member and the pressing member are brought into a press-contact state, and rotational drive for the heating member and the pressing member is started.

4. The image forming apparatus according to claim 3, wherein if a detected temperature of the pressing member reaches the first temperature, the heating member and the pressing member are separated from each other again.

5. The image forming apparatus according to claim 1, wherein the pressing member further includes a heating unit, and if a detected temperature of the heating member reaches the target temperature of the heating member, the heating unit starts heating of the pressing member by the heating member.

6. The image forming apparatus according to claim 4, wherein the pressing member further includes a heating unit, and if a detected temperature of the heating member reaches the target temperature, the heating unit starts heating of the pressing member.

7. An image forming apparatus comprising:

an image forming unit that forms an image on a recording medium;

a heating member that heats the image formed on the recording medium in a nip section;

an endless belt that conveys the recording medium toward the nip section formed between the endless belt and the heating member;

a separating mechanism that separates the heating member and the endless belt; and a first temperature detecting unit that detects temperature of the endless belt, wherein in forming the nip section with the heating member and the endless belt to heat the heating member to a target temperature, if a detected temperature of the endless belt reaches a first temperature lower than the target temperature of the heating member, the heating member and the endless belt are separated from each other.

8. The image forming apparatus according to claim 7, further comprising:

a second temperature detecting unit that detects temperature of the heating member, wherein in case of heating the heating member to the target temperature of the heating member, if a detected temperature of the heating member reaches a second temperature lower than the first temperature after forming the nip section with the heating member and the endless belt, rotational drive for the heating member and the endless belt is started.

9. The image forming apparatus according to claim 7, wherein in case of heating the heating member to the target temperature of the heating member after a power supply for the image forming apparatus is turned on, the heating member and the endless belt are separated from each other by the separating mechanism, and if a detected temperature of the heating member reaches a third temperature lower than the target temperature of the heating member and higher than the first temperature, the heating member and the endless belt are brought into a press-contact state, and rotational drive for the heating member and the endless belt is started.

10. The image forming apparatus according to claim 9, wherein if a detected temperature of the pressing member reaches the first temperature, the heating member and the endless belt are separated from each other again.

11. The image forming apparatus according to claim 7, further comprising:

a belt heating unit that heats the endless belt, wherein if a detected temperature of the heating member reaches the target temperature of the heating member, heating by the belt heating unit is started.

12. The image forming apparatus according to claim 10, further comprising;

a belt heating unit that heats the endless belt, wherein if a detected temperature of the heating member reaches the target temperature of the heating member, heating by the belt heating unit is started.

* * * * *